US009685745B2

(12) United States Patent
Endo et al.

(10) Patent No.: US 9,685,745 B2
(45) Date of Patent: Jun. 20, 2017

(54) CONNECTOR TERMINAL

(71) Applicant: DAI-ICHI SEIKO CO., LTD., Kyoto (JP)

(72) Inventors: Takayoshi Endo, Shizuoka (JP); Shuji Touno, Shizuoka (JP)

(73) Assignee: DAI-ICHI SEIKO CO., LTD. (JP)

( * ) Notice: Subject to any disclaimer, the term of this patent is extended or adjusted under 35 U.S.C. 154(b) by 0 days.

(21) Appl. No.: 14/961,826

(22) Filed: Dec. 7, 2015

(65) Prior Publication Data

US 2016/0172799 A1 Jun. 16, 2016

(30) Foreign Application Priority Data

Dec. 12, 2014 (JP) ..... 2014-252495

(51) Int. Cl.

| | |
|---|---|
| ***H01R 24/38*** | (2011.01) |
| ***H01R 13/24*** | (2006.01) |
| ***H01R 13/432*** | (2006.01) |
| ***H01R 13/11*** | (2006.01) |
| *H01R 24/86* | (2011.01) |

(52) U.S. Cl.
CPC ..... *H01R 24/38* (2013.01); *H01R 13/111* (2013.01); *H01R 24/86* (2013.01)

(58) Field of Classification Search
CPC ..... H01R 24/38; H01R 13/24; H01R 13/432
See application file for complete search history.

(56) References Cited

U.S. PATENT DOCUMENTS 3,742,430 A * 6/1973 Cairns ..... H01R 12/721 439/862
5,090,925 A * 2/1992 Sato ..... H01R 13/17 439/862
5,271,740 A 12/1993 Endo et al. ..... 439/637
5,456,617 A * 10/1995 Chishima ..... H01R 31/08 439/189

(Continued)

FOREIGN PATENT DOCUMENTS

DE 0 924 804 12/1998 ..... H01R 13/24
JP H07037265 8/1995 ..... H01R 17/04

(Continued)

OTHER PUBLICATIONS

Office Action issued in corresponding German Patent Appln. No. 10 2015 225 007.5 dated Aug. 8, 2016, with English translation (9 pgs).

(Continued)

*Primary Examiner* — Amy Cohen Johnson
*Assistant Examiner* — Matthew T Dzierzynski
(74) *Attorney, Agent, or Firm* — Hayes Soloway P.C.

(57) ABSTRACT

A connector terminal includes a terminal body operable to be inserted into a terminal space formed in a housing, and an elastic contact piece arranged in the terminal body. The connector terminal contacts an inner peripheral surface of a cylindrical terminal while being inserted into the terminal space. The elastic contact piece includes a contact portion constituted of an arc surface, and also includes at least one projection formed on the contact portion, the at least one projection contacting an inner arc surface of the cylindrical terminal. The at least one projection extends in a length-wise direction of the cylindrical terminal.

16 Claims, 34 Drawing Sheets

(56) References Cited

U.S. PATENT DOCUMENTS

| | | | | |
|---|---|---|---|---|
| 6,186,837 | B1 | 2/2001 | Abe | 439/748 |
| 6,217,396 | B1 * | 4/2001 | Hwang | H01R 13/2442 439/862 |
| 6,398,590 | B2 * | 6/2002 | Banas | H01R 24/58 439/395 |
| 6,589,082 | B2 * | 7/2003 | Harasawa | H01R 13/2442 439/595 |
| 6,607,406 | B2 * | 8/2003 | Banas | H01R 24/58 439/668 |
| 6,679,739 | B2 * | 1/2004 | Fujita | H01R 13/11 439/637 |
| 7,153,173 | B2 * | 12/2006 | Harasawa | H01R 13/2442 439/862 |
| 8,079,876 | B2 * | 12/2011 | Wang | H01R 13/2442 439/630 |
| 2002/0009918 | A1 | 1/2002 | Banas et al. | 439/404 |
| 2005/0009390 | A1 | 1/2005 | Barker et al. | 439/188 |
| 2014/0099818 | A1 * | 4/2014 | Endo | H01R 13/6315 439/378 |
| 2015/0311627 | A1 * | 10/2015 | Endo | H01R 13/6315 439/378 |
| 2016/0064845 | A1 * | 3/2016 | Endo | H01R 13/02 439/884 |

FOREIGN PATENT DOCUMENTS

| | | | |
|---|---|---|---|
| JP | H0935825 | 2/1997 | H01R 23/26 |
| JP | H113739 | 1/1999 | H01R 13/428 |
| JP | 2598581 | 6/1999 | H01R 13/05 |
| JP | 2002075558 | 3/2002 | H01R 13/04 |
| JP | 2005085649 | 3/2005 | H01R 13/11 |
| JP | 2007521181 | 8/2007 | B60R 21/26 |
| JP | 2009-211874 | 9/2009 | H01R 13/05 |
| JP | 2011216439 | 10/2011 | H01R 24/00 |

OTHER PUBLICATIONS

U.S. Appl. No. 14/961,818, filed Dec. 7, 2015, Endo et al.
U.S. Appl. No. 14/961,831, filed Dec. 7, 2015, Endo et al.
U.S. Appl. No. 14/962,858, filed Dec. 8, 2015, Endo et al.

* cited by examiner

CONNECTOR TERMINAL

BACKGROUND OF THE INVENTION

Field of the Invention

The present invention relates to a connector terminal including an elastic contact piece having a contact portion through which the elastic contact piece contacts a cylindrical terminal.

Description of the Related Art

A kind of electrical connector (such as a connector to be equipped in a glow plug acting as an ignitor or a pre-heating plug in an engine, and a connector used for connecting a combustion pressure sensor to a wire harness) includes a cylindrical male connector. Since the male connector is designed to be rotation-symmetric with a female connector, the male connector can be fit into the female connector, even if the male connector is caused to rotate around an axis thereof in either direction. Accordingly, the male connector can be readily fit into the female connector, even if the connectors are manually handled in the darkness.

The electrical connector as mentioned above generally includes an elastic contact piece having a contact portion through which the elastic contact piece contacts the cylindrical terminal.

FIG. 32 is a perspective view of a conventional electrical connector disclosed in Japanese Patent Application Laid-open on No. 1997-35825.

The illustrated electrical connector includes a plug connector 1000 and a receptacle connector 1010.

The plug connector 1000 includes a cylindrical plug insulator 1001, and a plurality of contacts 1002 arranged on an outer surface of the plug insulator 1001 such that a distance from a distal end of the plug insulator 1001 to each of the contacts 1002 is different from others. The receptacle connector 1010 is formed with a hole 1011 into which the plug connector 1000 can be fit. The receptacle connector 1010 includes a plurality of circular receptacle contacts 1012 formed on an inner surface of the hole 1011.

FIG. 33 is a perspective view of the contact 1002. The contact 1002 is in shape of an arc, and is formed thereon centrally with a bead 1002*a*. The bead 1002*a* makes point-contact at a top thereof with the receptacle contact 1013 of the receptacle connector 1010.

FIG. 34 is a perspective view of another conventional electrical connector disclosed in Japanese Patent Application Laid-open on No. 2002-75558.

The illustrated electrical connector includes a receptacle connector sub-assembly 1110 and a plug connector sub-assembly 1120. The receptacle connector sub-assembly 1110 includes receptacle contacts 1101, 1102 and 1103 each including an elastic canti-lever 1104 having a contact 1104*a*. The receptacle contacts 1101, 1102 and 1103 are positioned in different locations in an axial direction of the receptacle connector sub-assembly 1110. The plug connector sub-assembly 1120 includes cylindrical plug contacts 1121, 1122 and 1123 each of which contacts each of the contacts 1104*a*.

In the conventional electrical connector illustrated in FIG. 32, each of the contacts 1002 is formed in shape of an arc, and is formed centrally with the bead 1002*a*. However, since the beads 1002*a* merely contact the cylindrical receptacle contact 1013, it is unavoidable for the contacts 1002 to unstably contact the receptacle contact 1013.

The conventional electrical connector illustrated in FIG. 34 is accompanied with a problem that since arc surfaces of the contacts 1104*a* of the receptacle contacts 1101, 1102 and 1103 are convex in a direction perpendicular to a direction in which arc surfaces of the cylindrical plug contacts 1121, 1122 and 1123 extend, if a direction in which the receptacle contacts 1101, 1102 and 1103 extend is deviated from an axial direction of the cylindrical plug contacts 1121, 1122 and 1123, it is afraid that the contacts 1104*a* unstably contact the cylindrical plug contacts 1121, 1122 and 1123.

The contacts 1104*a* may be designed to have an arc surface extending along an arc surface of the cylindrical plug contacts 1121, 1122 and 1123. However, irregularity in each of the arc surfaces causes the arc surface of the contacts 1104*a* to incline, resulting in that it is quite difficult for the contacts 1104*a* to stably contact the cylindrical plug contacts 1121, 1122 and 1123.

SUMMARY OF THE INVENTION

In view of the above-mentioned problems in the conventional electrical connectors, it is an object of the present invention to provide a connector terminal capable of stably contacting another connector terminal to thereby ensure high reliability to the connection therebetween.

A first aspect according to the present invention provides a connector terminal, comprising: a terminal body operable to be inserted into a terminal space formed in a housing; and an elastic contact piece arranged in the terminal body, wherein: the connector terminal contacts an inner peripheral surface of a cylindrical terminal while being inserted into the terminal space; the elastic contact piece includes a contact portion constituted of an arc surface; the elastic contact piece includes at least one projection formed on the contact portion, the at least one projection contacting an inner arc surface of the cylindrical terminal; and the at least one projection extends in a length-wise direction of the cylindrical terminal.

In the connector terminal according to the present invention, the elastic contact piece is designed to have a contact portion constituted of an arc surface, and include at least one projection formed on the contact portion. The connector terminal is able to contact the cylindrical terminal through the projection of the elastic contact piece.

A second aspect according to the present invention provides, in addition to the first aspect, a connector terminal wherein: the elastic contact piece further includes a plurality of projections each contacting the inner arc surface of the cylindrical terminal; the plurality of projections are arranged in a peripheral direction of the inner arc surface of the cylindrical terminal; and each of the plurality of projections extending in a length-wise direction of the cylindrical terminal.

Even if a curvature of the arc surface of the cylindrical terminal and/or a curvature of the contact portion of the elastic contact piece have/has irregularity, the elastic contact piece can contact the cylindrical terminal at two or more points. Consequently, it is possible to cause the connector terminal to stably contact the cylindrical terminal.

A third aspect according to the present invention provides, in addition to the second aspect, a connector terminal wherein the plurality of projections are equally spaced away from one another in the peripheral direction.

Since the projections uniformly contact the arc inner surface of the cylindrical terminal, the elastic contact piece can further stably contact the cylindrical terminal.

A fourth aspect according to the present invention provides, in addition to the second aspect, a connector terminal wherein the plurality of projections are arranged symmetrically about a top of the contact portion.

A fifth aspect according to the present invention provides, in addition to the first aspect, a connector terminal wherein each of the plurality of projection has an arc cross-section.

A sixth aspect according to the present invention provides, in addition to the first aspect, a connector terminal wherein the contact portion has a curvature equal to that of the inner arc surface of the cylindrical terminal.

A seventh aspect according to the present invention provides, in addition to the first aspect, a connector terminal wherein: the terminal body includes: a first wall; and a second wall facing the first wall spaced away therefrom; the second wall is formed with an opening; the elastic contact piece further includes: a first end fixed to the first wall; a second end abutting on the second wall and being a free end; and a substantially U-shaped bent portion located between the first end and the second end; the terminal space includes a raised portion having a height from the first wall towards the second wall; and when the terminal body is inserted into the terminal space, the bent portion runs onto the raised portion, and the contact portion projects out of the opening, and further, the second end abuts on the first wall.

The contact portion of the elastic contact piece is kept not projecting out of the opening until the bent portion runs onto the raised portion after the connector terminal was inserted into the terminal space. When the bent portion runs onto the raised portion, the contact portion projects out of the opening, and the free second end contacts the first wall of the terminal body. Thus, the bent portion can maintain a shape obtained when the connector terminal was inserted into the terminal space. Furthermore, by designing the second end to be a free end, when the contact portion of the elastic contact piece contacts the cylindrical terminal to thereby receive a load from the cylindrical terminal, the second end moves backwardly of the terminal body. Accordingly, it is possible to reduce a load exerting onto the second end.

An eighth aspect according to the present invention provides, in addition to the first aspect, a connector terminal wherein: the elastic contact piece further includes a curved portion defining a convex towards the first wall from the second wall; the second end is continuous to the curved portion; and when the bent portion runs onto the raised portion, the curved portion, in place of the second end, abuts on the first wall.

Since the second end is continuous to the curved portion, the elastic contact piece contacts the first wall at the curved portion. Accordingly, it is possible to prevent the first wall from being damaged. Furthermore, since the curved portion slides on the first wall, the elastic contact piece can readily move on the first wall.

The advantages obtained by the aforementioned present invention will be described hereinbelow.

According to the present invention, the connector terminal and the cylindrical terminal can stably contact each other, ensuring high reliability to electrical connection therebetween.

In particular, by designing the elastic contact piece to include a plurality of projections, the connector terminal and the cylindrical terminal can more stably contact each other.

The advantages obtained by the aforementioned present invention will be described hereinbelow.

The connector terminal according to the present invention is inserted into the terminal space, and thus, the folded portion of the elastic contact piece runs onto a raised portion, resulting in that the part of the elastic contact piece is exposed out of the terminal body, and further, the second end of the elastic contact piece, which is a free end, contacts the bottom wall to thereby act as a fulcrum for supporting the elastic contact piece. Thus, when having not been yet inserted into a housing, the connector terminal according to the present invention makes it possible to prevent the elastic contact piece from being damaged and/or deformed, and further, to ensure a sufficient spring length when the connector terminal is inserted into the housing, to thereby ensure a necessary contact pressure between the elastic contact piece and another terminal.

DESCRIPTION OF THE PREFERRED EMBODIMENTS

A connector terminal according to the first embodiment of the present invention will be explained hereinbelow with reference to drawings.

In the specification, with respect to words of "front and rear," a word of "front" means a side through which the two electrical connectors are fit into each other, and a word of "rear" means the opposite side of the "front".

Figure 1:
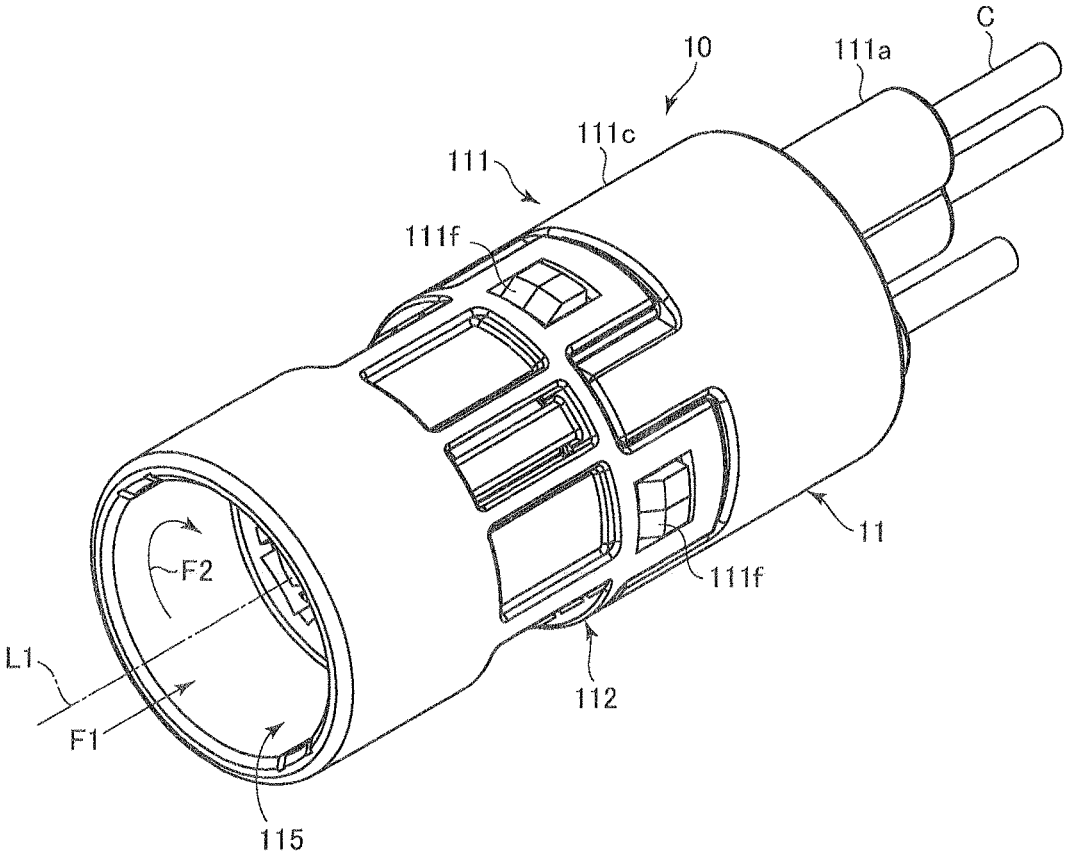
FIG. 1 is a perspective view of a first electrical connector in a preferable embodiment according to the present invention.
Figure 10:
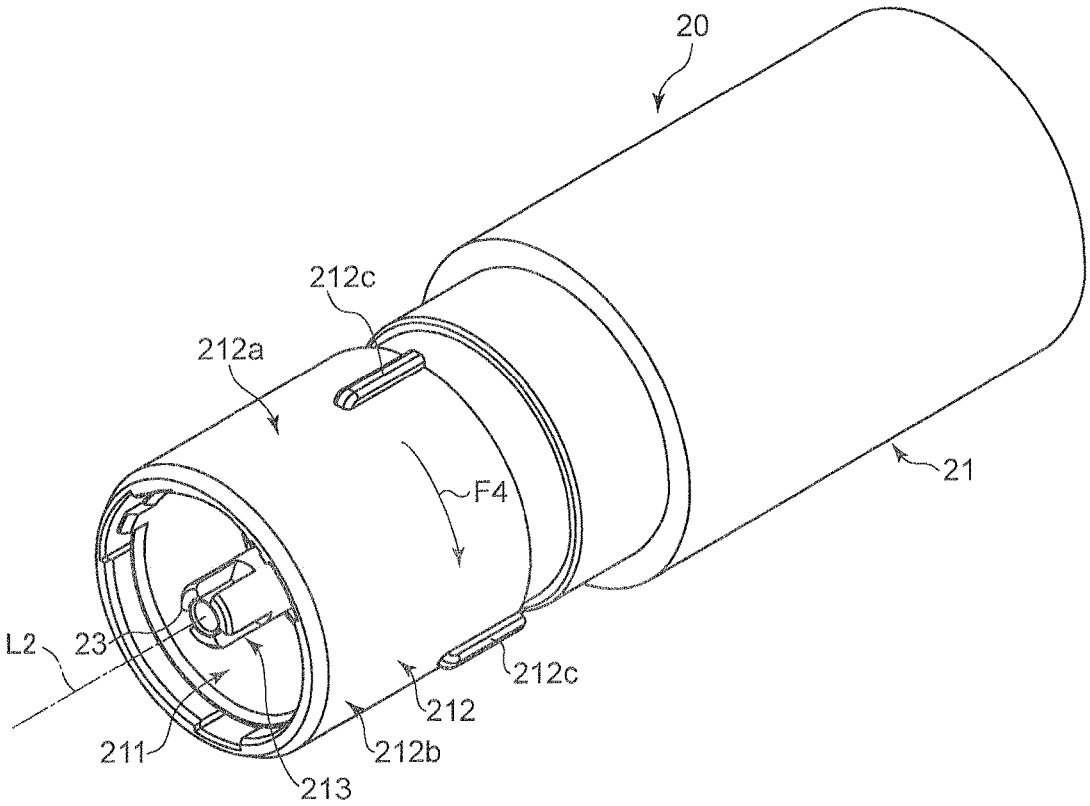
FIG. 10 is a perspective view of a second electrical connector in the preferable embodiment according to the present invention.

A first electrical connector 10 illustrated in FIG. 1 and a second electrical connector 20 illustrated in FIG. 10 can be used for connecting various kinds of sensors with a wire harness, for example. The second electrical connector 20 is the connector terminal according to the present invention.

First, the first electrical connector 10 is explained hereinbelow with reference to FIGS. 1 to 9.

Figure 2:
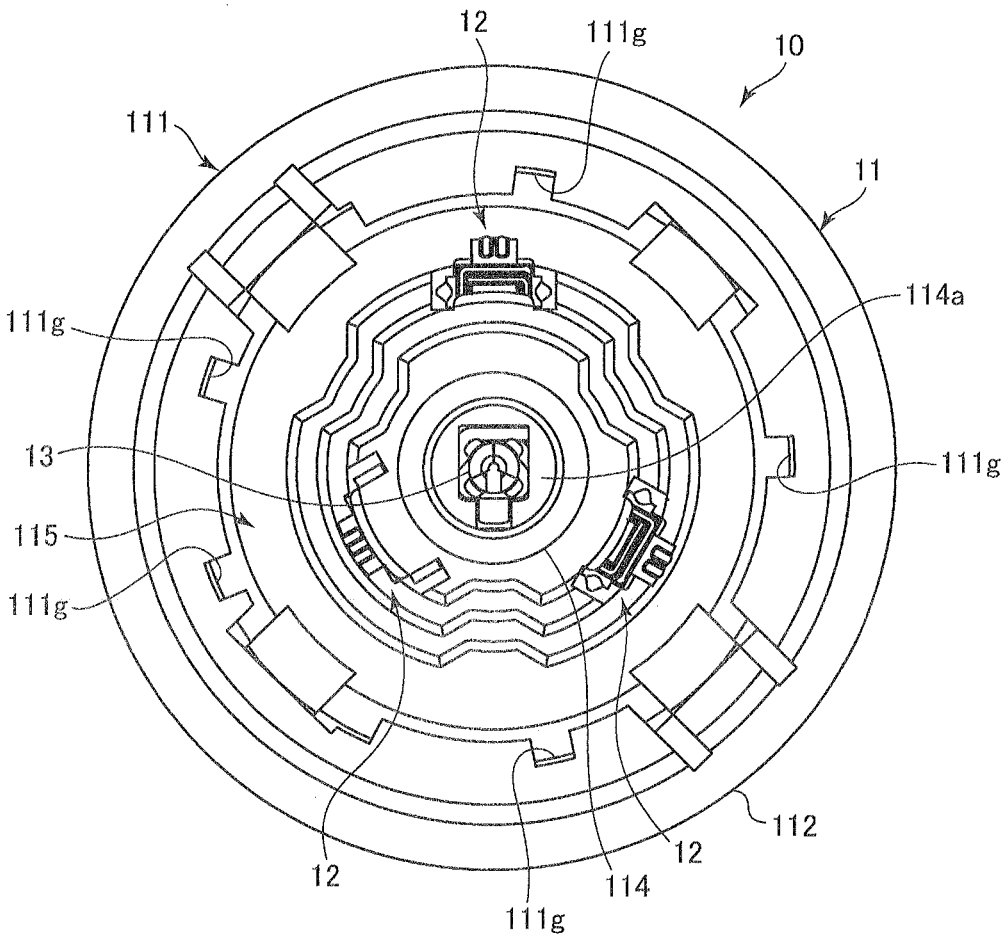
FIG. 2 is a front view of the first electrical connector illustrated in FIG. 1.
Figure 14:
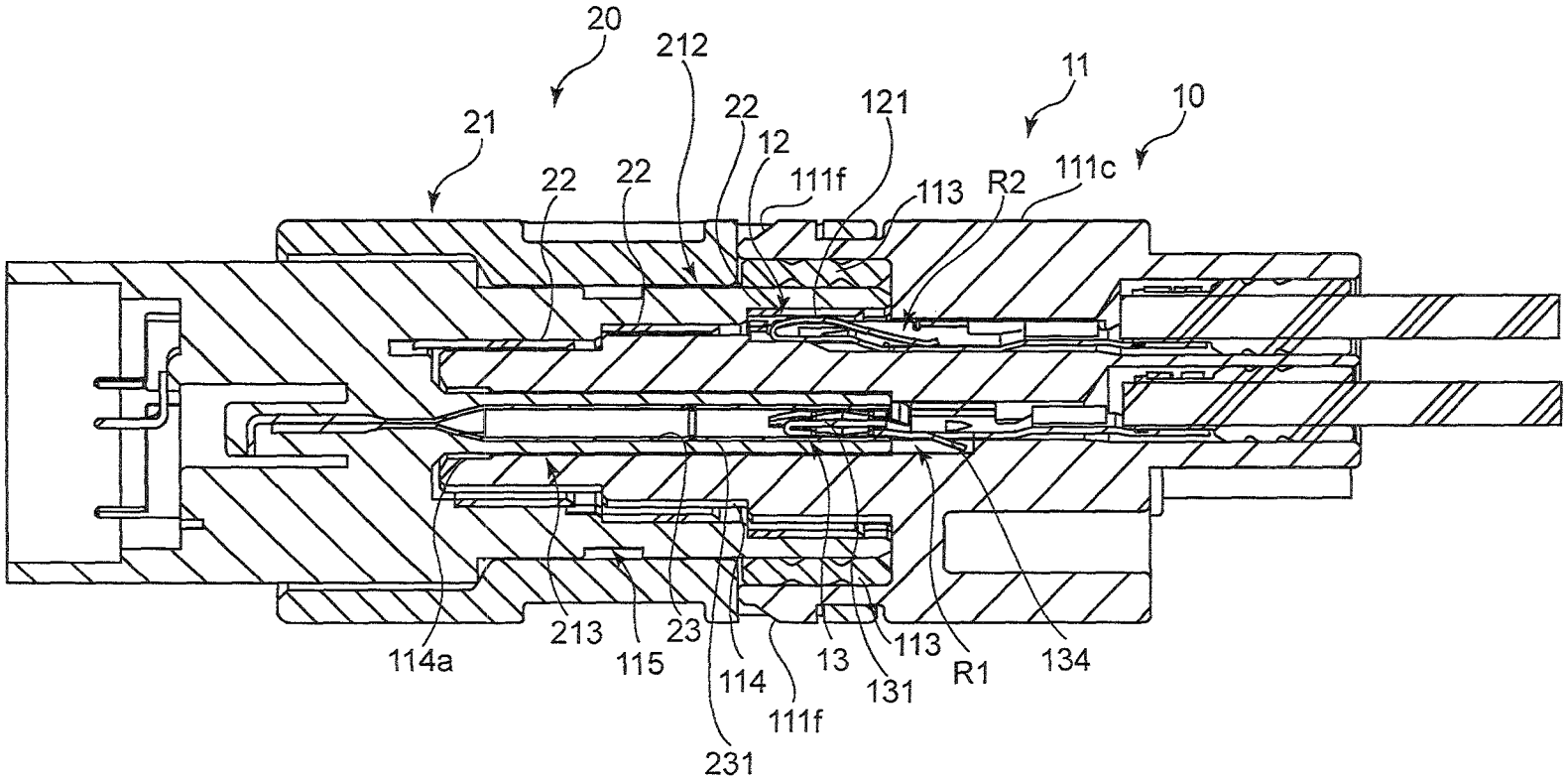
FIG. 14 is a cross-sectional view showing a state where the first connector terminal illustrated in FIG. 1 and the second connector terminal illustrated in FIG. 10 are fitted with each other.

As illustrated in FIGS. 1, 2 and 14, the first electrical connector 10 includes: an outer housing 11 (a first housing) into which the second electrical connector 20 illustrated in FIG. 10 is fit; a plurality of first contact terminals 12 (connector terminals) through which the first electrical connector 10 is electrically connected with the second electrical connector 20; and a projecting terminal 13 through which the first electrical connector 10 is electrically connected with the second electrical connector 20.

The outer housing 11 is cylindrical in shape. The outer housing 11 is constituted of a first member 111 and a second member 112.

The first member 111 includes a cover portion 111*a* at a rear end of the outer housing 11. The cover portion 111*a* protects a connector through which cables C are connected with terminals (the first contact terminals 12 and the projecting terminal 13), and houses a seal 124 (See, FIG. 3.) therein. The first member 111 further includes a first shaft 114 provided with a terminal space R1 into which the projecting terminal 13 is to be inserted. The first shaft 114 extends coaxially with a central axis L1 of the outer housing 11.

Figure 15:
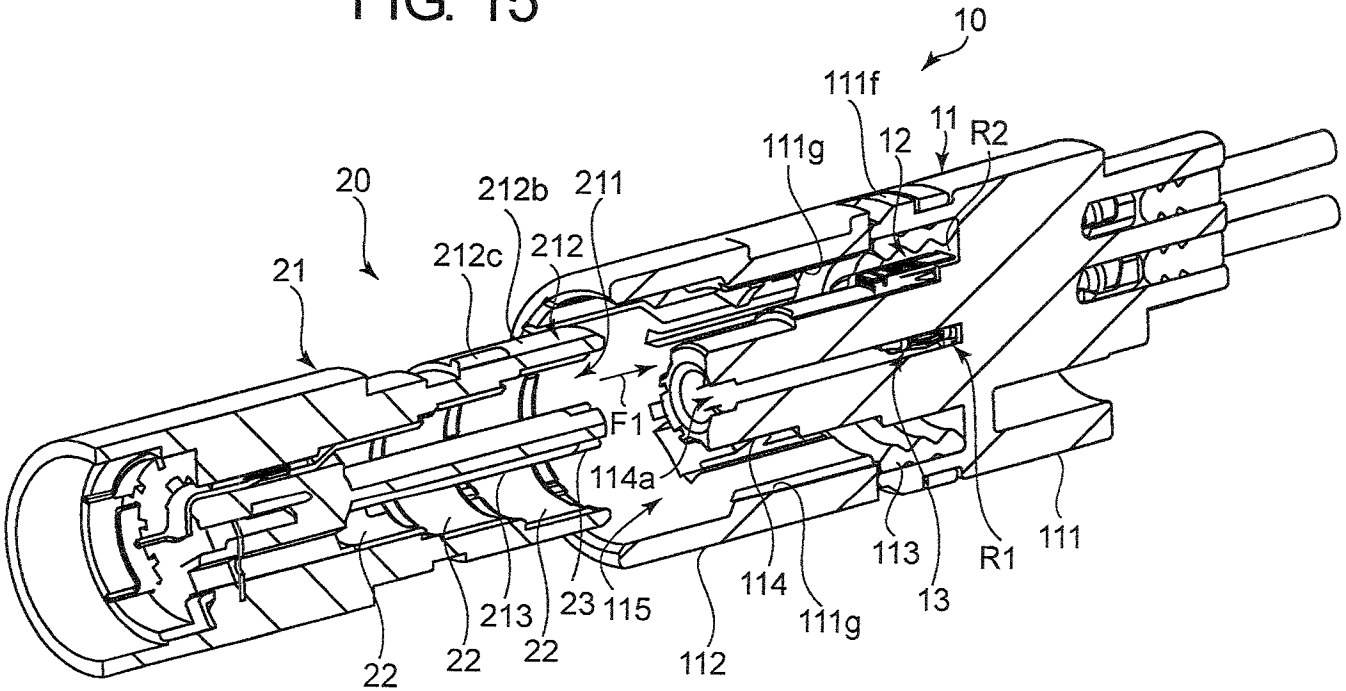
FIG. 15 is a perspective cross-sectional view showing a state where the first connector terminal illustrated in FIG. 1 and the second connector terminal illustrated in FIG. 10 are fitted with each other.

As illustrated in FIG. 15, the first shaft 114 is designed to have three stages each having a diameter increasing toward a proximal end from an open end thereof. Specifically, the first shaft 114 includes: a front end stage; a middle stage; and a rear end stage, in which the front stage has a diameter smaller than that of the middle stage, and the middle stage has a smaller diameter than that the rear end stage.

A guide hole 114*a* extending axially of the first shaft 114 to lead to the terminal space R1 is formed in the first shaft 114.

The first member 111 includes: a peripheral wall part 111*c* provided with a terminal space R2 between itself and the first shaft 114 for allowing the first contact terminals 12 to be inserted thereinto; and a locking piece 111*f* through which the first member 111 is engaged with the second member 112.

The second member 112 is cylindrical, and a first fitting hole 115 between the first shaft 114 and itself is formed when coupled to the first member 111. The second electrical connector 20 (See, FIG. 16.) is fit into the thus formed first fitting hole 115.

As illustrated in FIG. 2, a plurality of linear grooves 111*g* arranged radially of the central axis L1 of the outer housing and extending in a length-wise direction F1 the first electrical connector 10 formed on an inner surface of the first fitting hole 115 surrounded by the second member 112. In the second member 112 of the first embodiment, the linear grooves 111*g* are formed on the inner surface of the first fitting hole 115 at five locations among nine locations spaced away from one another by 40 degrees in a peripheral angle.

As illustrated in FIG. 14, a seal member 113 of a ring shape is provided inside of a coupling part between the first member 111 and the second member 112 illustrated in FIG. 1.

As illustrated in FIGS. 2 and 14 each of the first contact terminals 12 is arranged on an outer surface of the first shaft 114 in parallel with a central axis of the first shaft 114. In front view of the first fitting hole 115, the first contact terminals 12 are peripherally equally spaced away from one another around the first shaft 114. In the first embodiment, the three first contact terminals 12 are arranged according to the three diameter stages of the first shaft 114 by 120 degrees of a peripheral angle of the outer housing 11.

As illustrated in FIGS. 3 to 6, each of the first contact terminals 12 includes: an electrically conductive elastic contact piece 121 formed by having a metal piece bent into a U-shape; a first terminal body 122 to be inserted into the terminal space R2 (See, FIG. 14.); and a bundling portion 123 onto which a cable C1 is compressed.

A first end 1211 of the elastic contact piece 121 is fixed by being integrated with a bottom wall 1221 of the first terminal body 122. The elastic contact piece 121 extends from the bottom wall 1221 and forms a U-shaped folded portion 1212 at the end thereof. The elastic contact piece 121 further extends inside of the first terminal body 122 and terminates at a second end 1213 of a free end.

The elastic contact piece 121 has a part acting as a contact part 1214 through which the elastic contact piece 121 contacts a later-mentioned first cylindrical terminal. The contact part 1214 has an arc possessing an outer surface along a peripheral arc surface of a later-mentioned first cylindrical terminal.

A plurality of slim projections 1214*a* are formed in the contact part 1214. In the first embodiment, two projections 1214*a* are formed. The projections 1214*a* are arranged on the elastic contact piece 121 in a direction F3 (a width direction of the elastic contact piece 121) perpendicular to the central axis L1 of the first cylindrical terminal.

Between the first end 1211 and the folded portion 1212, a first curved portion 1215 is formed. The first curved portion 1215 bends the folded portion 1212 toward the bottom wall 1211. In an initial condition of the elastic contact piece 121, the curved portion 1215 in the first embodiment is bent in a manner such that an ascent portion from the first end 1211, which is continuous to the bottom wall 1221, to an opening 1222*a* turns to the bottom wall 1221, which is the opposite side of the opening 1222*a*.

In the initial condition, the folded portion 1212 projects out of the bottom wall 1221 of the first terminal body 122, and the contact part 1214 does not project out of the opening 1222*a* formed at a top wall 1222 of the first terminal body 122. At the second end 1213 of the elastic contact piece 121, a second curved portion 1216 possessing a convex towards the bottom wall 1221 is formed.

Figure 3:
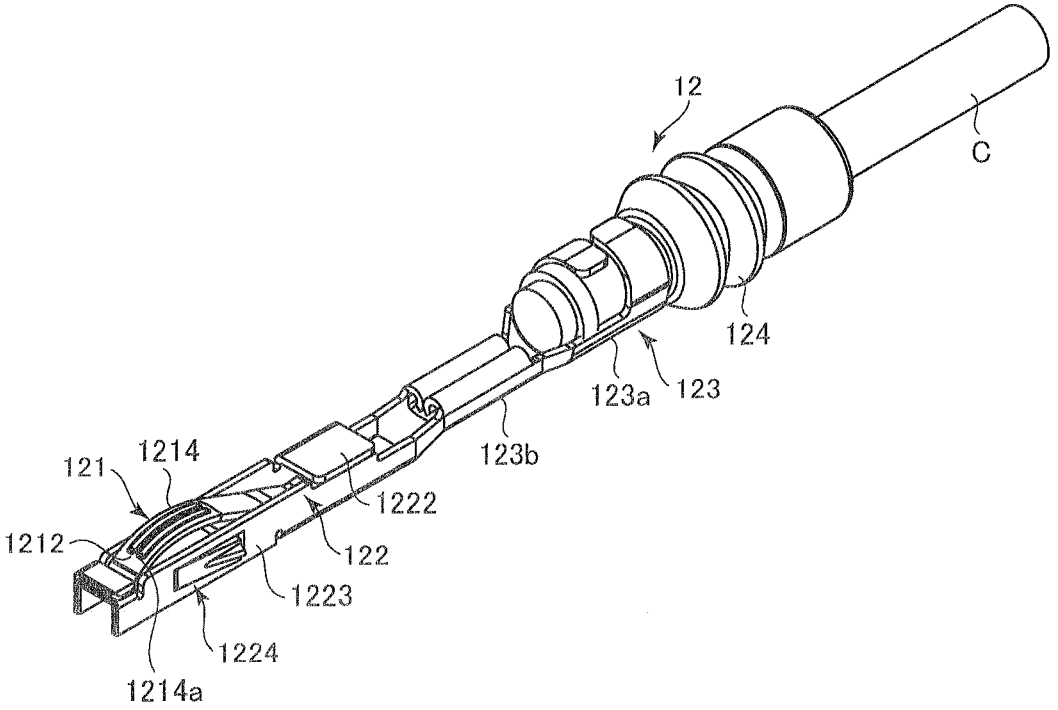
FIG. 3 is a perspective view of a connector terminal.

As illustrated in FIG. 3, the first terminal body 122 is designed to be hollow and have a rectangular cross-section.

The first terminal body 122 is formed at sidewalls 1223 thereof with a lance 1224. The lance 1224 is formed by forming a cutting line around a part of the sidewall 1223, and outwardly inclining the part.

Figure 26:
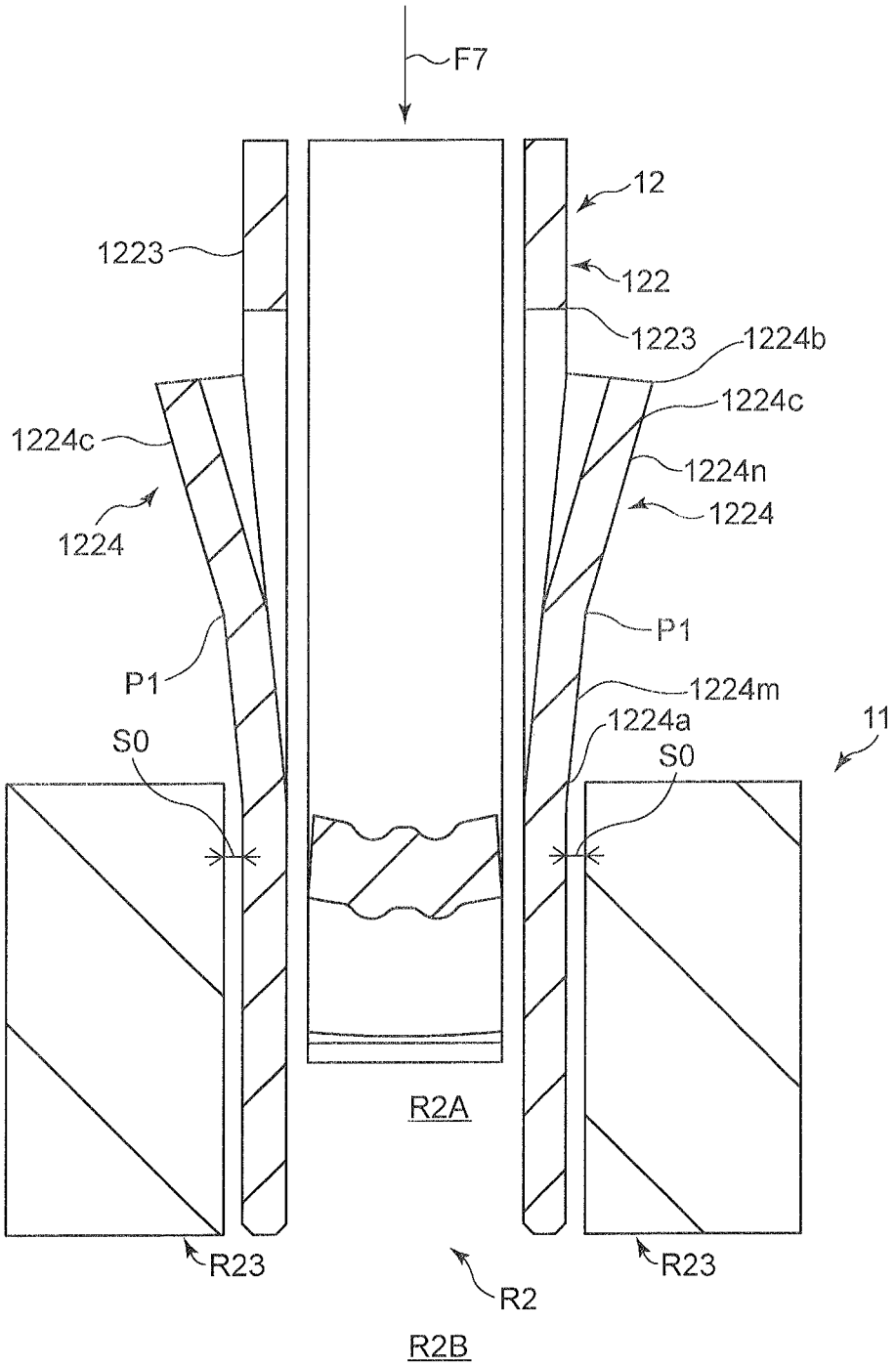
FIG. 26 is a partial cross-sectional view showing the connector terminal illustrated in FIG. 3, showing a state before being inserted into a terminal space.

As illustrated in FIG. 26, the lance 1224 prevents the first contact terminal 12 from being released out of the terminal space R2 after the first contact terminal 12 has been inserted into the terminal space R2 (See, FIG. 14.) of the outer housing 11.

Figure 27:
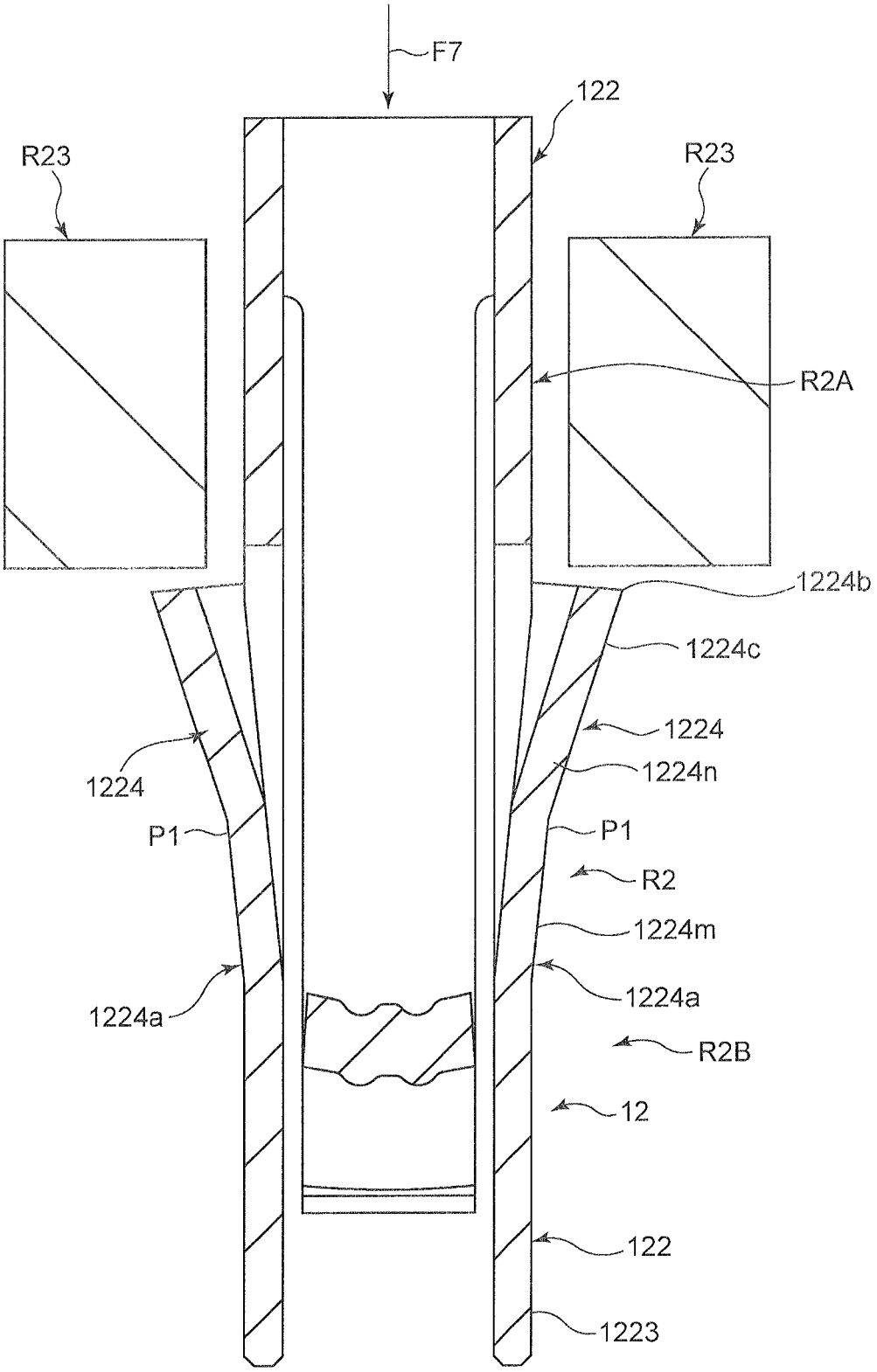
FIG. 27 is a partial cross-sectional view showing the connector terminal illustrated in FIG. 3, showing a state after having been inserted into a terminal space next to FIG. 26.

As illustrated in FIGS. 3, 26 and 27, the lance 1224 has an open end 1224*b* defining a slope 1224*c* inclining relative to the sidewall 1223 such that the open end 1224*b* is remotest from the sidewall 1213. Furthermore, the slope 1214*c* has a width varying in a length-wise direction of the first contact terminal 12 such that the width is in maximum at the open end 1224*b*.

The lance 1224 includes: a first slope portion 1224*m* extending from the first terminal body 122 at a first inclination angle relative to the first terminal body 122; and a second slope portion 1224*n* outwardly inclining from the first terminal body 122 at a second inclination angle greater than the first inclination angle relative to the first terminal body 122, and defining the slope 1224*e*.

Figure 4:
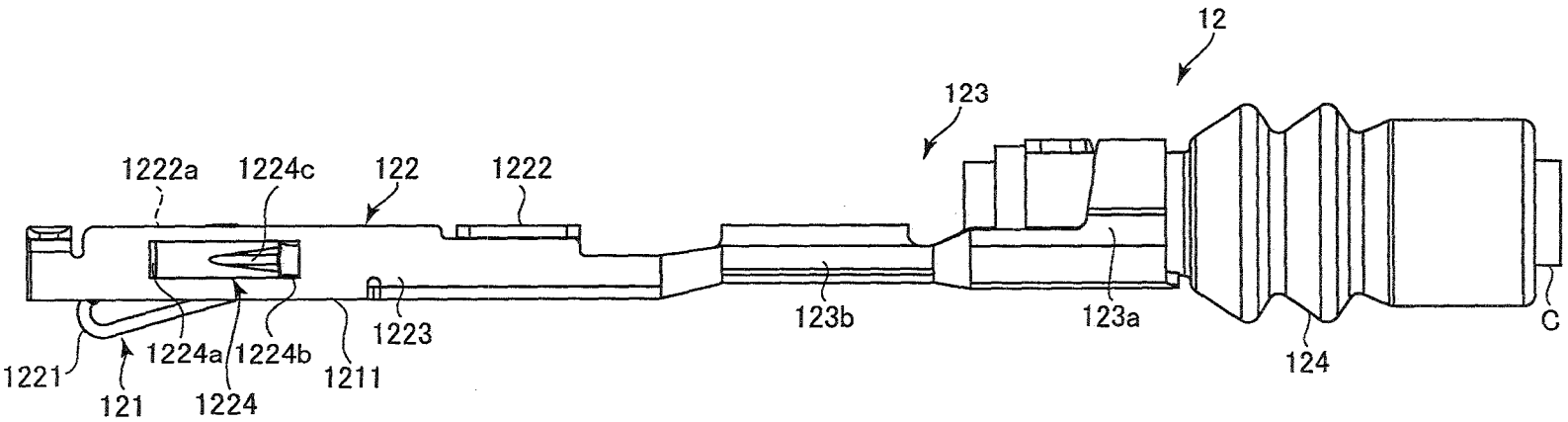
FIG. 4 is a side view of the connector terminal illustrated in FIG. 3.

As illustrated in FIG. 4, the bundling portion 123 compresses the cable C1 thereonto to fix the same therein. The bundling portion 123 includes an insulation barrel 123*a* and a wire barrel 123*b*. The first contact terminal 12 further includes a seal 124 into which the cable C1 is inserted, at a rear of the bundling portion 123.

Figure 9:
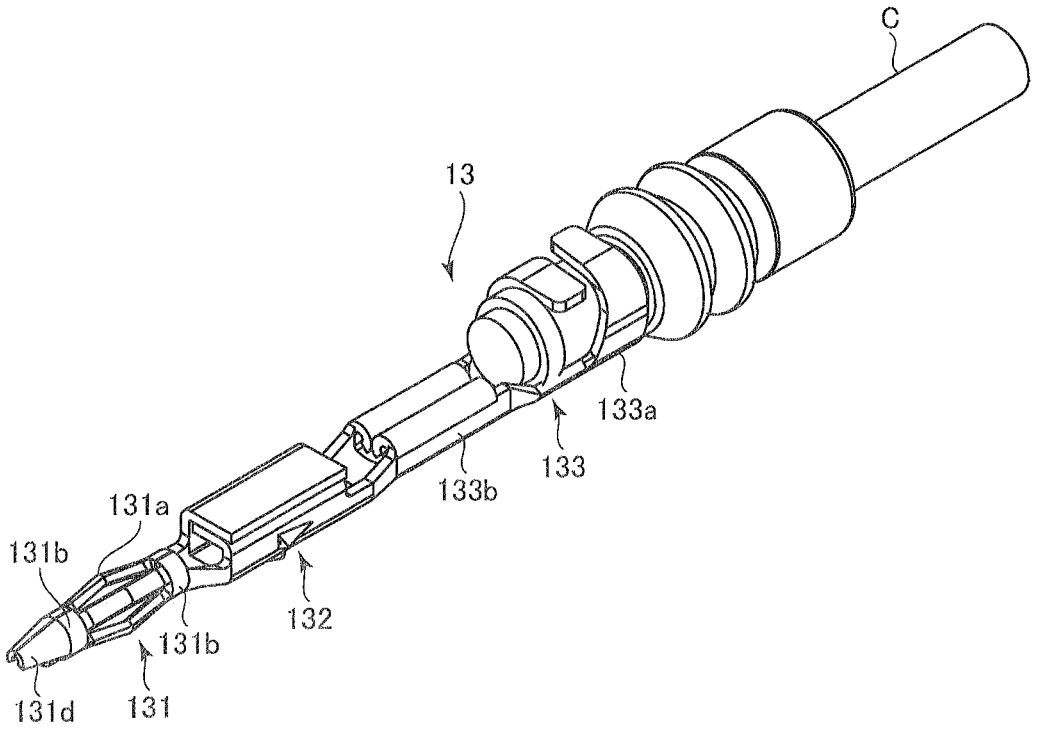
FIG. 9 is a perspective view of a projecting terminal illustrated in FIG. 1.

The projecting terminal 13 illustrated in FIG. 14 is housed in the terminal space R1 formed at a proximal end of the first shaft 114, and contacts a later-mentioned second cylindrical terminal of the second electrical connector 20. As illustrated in FIG. 9, the projecting terminal 13 includes: a contact portion 131; a second terminal body 132; and a bundling portion 133.

The contact portion 131 includes: a plurality of contact pieces 131*a* equally spaced away from one another; a pair of C-shaped binders 131*b* arranged at distal and proximal ends of the contact pieces 131*a*; and a cone portion 131*d* continuous to the binder 131*b* located at open ends of the contact pieces 131*a*.

The second terminal body 132 is hollow and has a rectangular cross-section.

The bundling portion 133 compresses the cable C1 thereonto to fix the same therein. The bundling portion 133 includes: an insulation barrel 133*a*; and a wire barrel 133*b*.

Hereinbelow, a structure of the second electrical connector 20 is explained referring to FIGS. 10 to 14.

Figure 11:
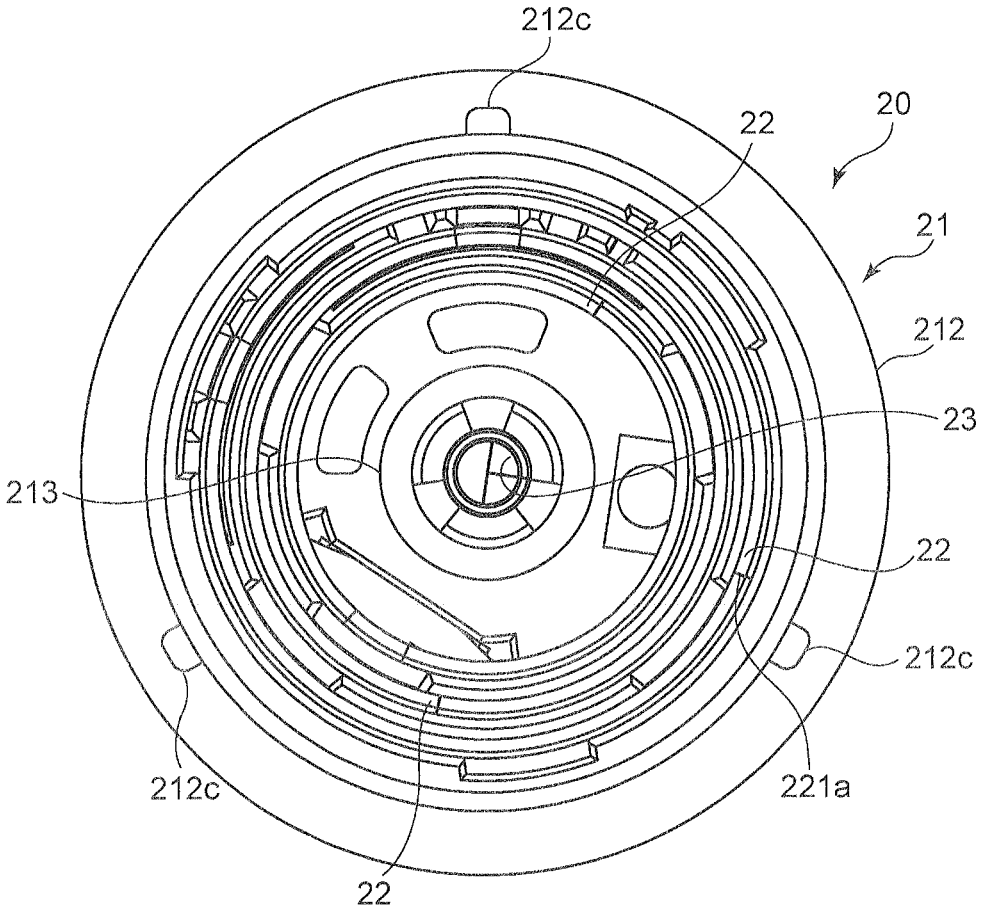
FIG. 11 is a front view of the second electrical connector illustrated in FIG. 10.

As illustrated in FIGS. 10, 11 and 14, the second electrical connector 20 includes: an inner housing 21 to be fit into the first electrical connector 10 illustrated in FIG. 1; a first cylindrical terminal 22 capable of electrically connecting with the first contact terminals 12 of the first electrical connector 10; and a second cylindrical terminal 23.

The inner housing 21 includes a peripheral wall part 212 in a front half of the inner housing 21. The peripheral wall part 212 defines therein a second fixing hole 211 into which the first shaft 114 of the first electrical connector 10 (See, FIG. 1.) is fit. The second fixing hole 211 is constituted of a plurality of stages each having an inner diameter gradually decreasing from an opening end toward a rear. The peripheral wall part 212 has an outer peripheral surface 212*a* contacting an inner surface of the first fitting hole 115 when the first electrical connector 10 is fit into the first fitting hole 115 of the second electrical connector 20. A front half of the peripheral wall part 212 is a cylindrical portion 212*b* on which no projection is formed. Three linear projections 212*c* each extending in a length-wise direction of the second electrical connector 20 are formed at a rear half of the peripheral wall part 212*a* radially of and around an axis L2 (See, FIG. 10.) of the inner housing 21. In the first embodiment, the linear projections 212*c* are equally spaced away from one another in a peripheral direction F4, that is, are arranged by 120 peripheral degrees.

A second shaft 213 extends in the second fixing hole 211. The second shaft 213 is cylindrical in shape, and includes the second cylindrical terminal 23 arranged therein.

Figure 12:
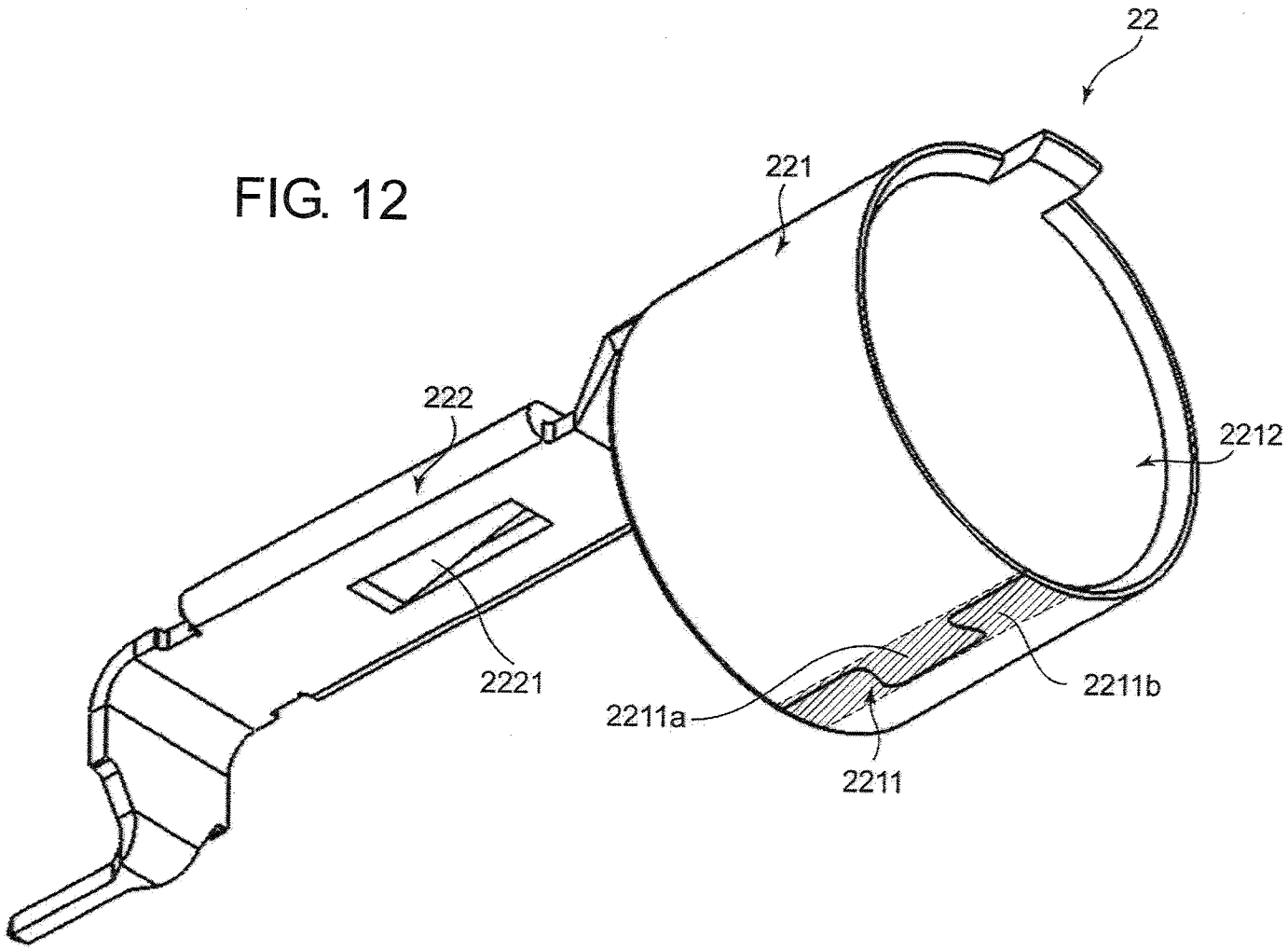
FIG. 12 is a perspective view of a first cylindrical terminal of in the second electrical connector illustrated in FIG. 10.

The first cylindrical terminal 22 is coaxial with the second shaft 213, and is fixed on an inner surface of the second fixing hole 211 of the inner housing 21 with a contact surface 2212 being exposed outside. As illustrated in FIG. 12, the first cylindrical terminal 22 includes: a cylindrical contact portion 221; and a linear connector portion 222.

The contact portion 221 contacts the elastic contact piece 121 of the first contact terminal 12 (See, FIG. 3.). The contact portion 221 is formed by joining opposite ends of electrically conductive sheets to each other through a joint portion 2211. For instance, a first end 2211*a* is designed to have a projection, and a second end 2211*b* is designed to have a recess. By fitting the projection into the recess and fixing them to each other, the ends 2211*a* and 2211*b* are joined to each other. Since the joint portion 2211 is defined by the combination of the above-mentioned projection and recess, the joint portion 2211 has a length ranging between proximal and open ends of the contact portion 221, and a width equal to a length of the projection or the recess.

As illustrated in FIG. 14, the second fixing hole 211 of the inner housing 21 defines therein three stages each having an inner diameter different from others. Specifically, a first stage located close to an open end of the second fixing hole 211 has a greatest inner diameter, a third stage located remotest from an open end of the second fixing hole 211 has a smallest inner diameter, and a second stage located between the first and third stages has an inner diameter smaller than an inner diameter of the first stage, but greater than an inner diameter of the third stage.

The second electrical connector 20 includes three first cylindrical terminals 22, each of which is arranged on an inner surface of each of the first to third stages defined in the second fixing hole 211 of the inner housing 21. The contact portion 211 of the first cylindrical terminal 22 arranged on an inner surface of the first stage has a greatest inner diameter among the contact portions 211 of the three first cylindrical terminals 22, the contact portion 211 of the first cylindrical terminal 22 arranged on an inner surface of the third stage has a smallest inner diameter among the contact portions 211 of the three first cylindrical terminals 22, and the contact portion 211 of the first cylindrical terminal 22 arranged on an inner surface of the second stage has an inner diameter intermediate between the greatest and smallest inner diameters.

The connecting portion 222 straightly extends from the contact portion 221 towards a rear end of the inner housing 21, and has an open end exposed out of the inner housing 21 and to be connected to a printed wiring board (not illustrated). The connecting portion 222 is formed with a lance 2221 for preventing the first cylindrical terminal 22 from being released from the inner housing 21.

As illustrated in FIGS. 10, 11 and 14, the second cylindrical terminal 23 is housed in the second shaft 213. The second cylindrical terminal 23 has an open end through which the projecting terminal 13 is inserted thereinto. The second cylindrical terminal 23 outwardly extends beyond the second shaft 213, and thus, is exposed at an open end thereof out of the second shaft 213. The second cylindrical terminal 23 is arranged to closely contact the second shaft 213 so as to be integrated therewith.

Figure 13:
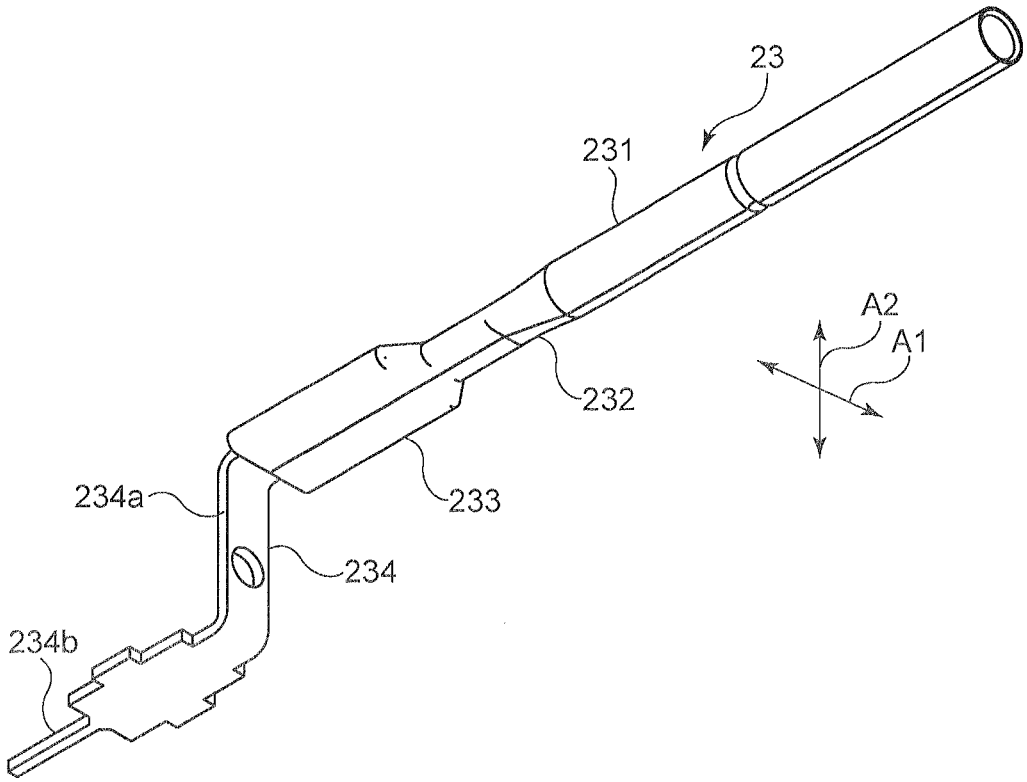
FIG. 13 is a perspective view of a second cylindrical terminal of the second electrical connector illustrated in FIG. 10.

As illustrated in FIG. 13, the second cylindrical terminal 23 includes: a cylindrical portion 231; a constricted part 232, a closed section 233; and an L-shaped connecting portion 234.

The constricted part 232 is located at a rear of the cylindrical portion 231, and has a thickness reduced in a direction in which the connecting portion 234 extends. Specifically, the constricted part 232 has a width (a length in a first direction A1) equal to a diameter of the cylindrical portion 231, and has a thickness (a length in a second direction A2 perpendicular to the first direction A1) gradually decreasing in a length-wise direction of the second cylindrical terminal 23 from a diameter equal to the same of the cylindrical portion 231. As a result of the reduction in a thickness, the constricted part 232 is finally flat.

The closed section 233 is located at a rear of the constricted part 232 and at a proximal end of the second cylindrical terminal 23. The closed section 235 has a width (a length in the direction A1) greater than the same of the constricted part 233. Furthermore, the closed section 233 has a thickness smaller than a diameter of the cylindrical portion 231 and a width greater than a diameter of the cylindrical portion 231.

The L-shaped connecting portion 234 is continuous to the closed section 233. The connecting portion 234 includes:

a plate-shaped portion 234*a* bending perpendicularly to the closed section 233, and further, perpendicularly bending to be in parallel with the cylindrical portion 231; and a needle portion 234*b* outwardly extending from an open end of the plate-shaped portion 234*a*.

How the first and second electrical connectors 10 and 20 configured as mentioned above are used is explained hereinbelow with reference to FIGS. 15 to 20.

As illustrated in FIG. 15, the first electrical connector 10 and the second electrical connector 20 are caused to come close to each other. Then, an open end of the peripheral wall part 212 (of the inner housing 21) is aligned with the first fitting hole 115 of the outer housing 11, and an open end of the second shaft 213 (of the inner housing 21) is also aligned with the guide hole 114*a* (of the first shaft 114).

Then, the peripheral wall part 212 (of the inner housing 21) is forwarded in the length-wise direction F1 of the first fitting hole 115, and the second shaft 213 (of the inner housing 21) is also forwarded in the length-wise direction F1 (of the guide hole 114*a*).

Figure 16:
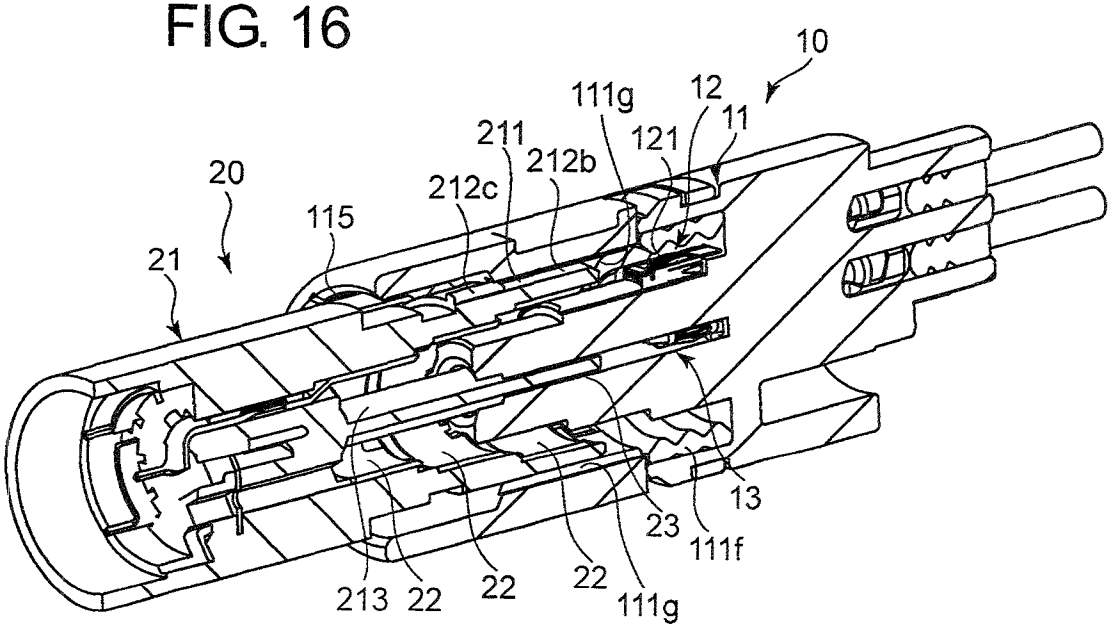
FIG. 16 is a perspective cross-sectional view showing a state where the first connector terminal illustrated in FIG. 1 and the second connector terminal illustrated in FIG. 10 are fitted with each other next to FIG. 15.

As illustrated in FIG. 16, a front half of the peripheral wall part 212 (of the inner housing 21) is the cylindrical portion 212*b* on which no projections are formed (See, FIG. 10.). Accordingly, when only the front half of the peripheral wall part 212 is inserted into the first fitting hole 115 (of the outer housing 11), the linear projections 212*c* (of the inner housing 21) are not yet fit into the linear grooves 111*g* (of the outer housing 11). Thus, a user can fit the outer housing 21 into the inner housing 11 with one of them being rotated around an axis thereof. A user can forward the inner housing 21 relative to the outer housing 11 without due care and attention to a direction of the rotation.

After the state in FIG. 16, the peripheral wall part 212 of the inner housing 21 is wholly forwarded into the first fitting hole 115 of the outer housing 11, and then the linear projections 212*c* of the peripheral wall part 212 are fit into the linear grooves 111*g* of the outer housing 11, thereby the outer housing 11 and the inner housing 21 are positioned relative to each other. Accordingly, the outer and inner housings 11 and 21 cannot rotate relative to each other.

Furthermore, when the peripheral wall part 212 is wholly forwarded into the first fitting hole 115, the projecting terminal 13 is inserted into the second cylindrical terminal 23 to contact therewith. In addition, each of the first cylindrical terminals 22 of the second electrical connector 20 contacts the elastic contact piece 121 of each of the first contact terminals 12 of the first electrical connector 10.

As mentioned above, the linear grooves 111*g* of the outer housing 11 and the linear projections 212*c* of the inner housing 21 constitute a positioning unit. The positioning unit is formed by inserting the inner housing 21 into the outer housing 11. Once formed, the positioning unit prohibits the relative rotation between the inner housing 21 and the outer housing 11 at a position where the first cylindrical terminals 22 and the elastic contact pieces 121 contact each other.

That is, at the beginning of the insertion, the second electrical connector 20 can act as an electrical connector that can freely rotate from the first electrical connector 10 about a direction of the insertion.

After the positioning unit of the outer housing 11 and the inner housing 21 has been formed, the first cylindrical terminals 22 contact the elastic contact pieces 121. That is, when the first cylindrical terminals 22 contact the elastic contact pieces 121, the relative rotation between the inner housing 21 and the outer housing 11 has been already prohibited. Consequently, the cylindrical contact portion 221 (of the first cylindrical terminal 22) and the elastic contact piece 121 (of the first contact terminal 12) are neither worn down nor damaged caused by the relative rotation between the first and second electrical connectors 10 and 20.

Even if an axis of the second cylindrical terminal 23 is deviated from an axis of the projecting terminal 13, there is no problem according to the following reason. That is, when the projecting terminal 13 starts being fit into the second cylindrical terminal 23, the contact portion 131 slides on an inner surface of the second cylindrical terminal 23. The sliding action automatically corrects a posture of the contact portion 131 of the projecting terminal 13.

However, the projecting terminal 13 is housed in the terminal space R1 with a gap between the projecting terminal 13 and an inner surface of the first shaft 114, and further, is locked by the lance 134. Accordingly, even if the posture of the contact portion 131 is corrected by the second cylindrical terminal 23, the second terminal body 132 of the projecting terminal 13 can be shifted, within the terminal space R1, to a new axial direction in which the posture of the contact portion 131 is corrected. Consequently, the projecting terminal 13 can be moved to follow the new axial direction of the second cylindrical terminal 23.

As illustrated in FIG. 14, by further inserting the second electrical connector 20 into the first electrical connector 10, the peripheral wall part 212 of the inner housing 21 is completely fit into the first fitting hole 115 of the outer housing 11, the first shaft 14 of the outer housing 11 is completely fit into the second fixing hole 211 of the inner housing 21, and the second shaft 213 of the inner housing 21 is completely fit into the guide hole 114*a* of the first shaft 114.

In this situation, each of the first contact terminals 12 arranged on an outer surface of the first shaft 114 contacts each of the contact portions 221 of the first cylindrical terminals 22 arranged on an inner surface of the inner housing 21. And, the contact portion 131 of the projecting terminal 13 is inserted into the cylindrical portion 231 of the second cylindrical terminal 23 to contact therewith.

Thus, the first and second electrical connectors 10 and 20 are fit with each other.

The first contact terminals 12 are arranged on an outer surface of the first shaft 114 coaxially with a central axis of the first shaft 114. The first cylindrical terminals 22 are arranged on an inner surface of the inner housing 21 coaxially with the second shaft 213. Thus, when the first shaft 114 and the second shaft 213 are fit into each other, the first contact terminals 12 can stably contact the first cylindrical terminals 22.

Hereinbelow is explained another positioning unit for positioning the outer and inner housings 11 and 21 in a peripheral direction when they are fit into each other as they rotate relative to each other.

Figure 17:
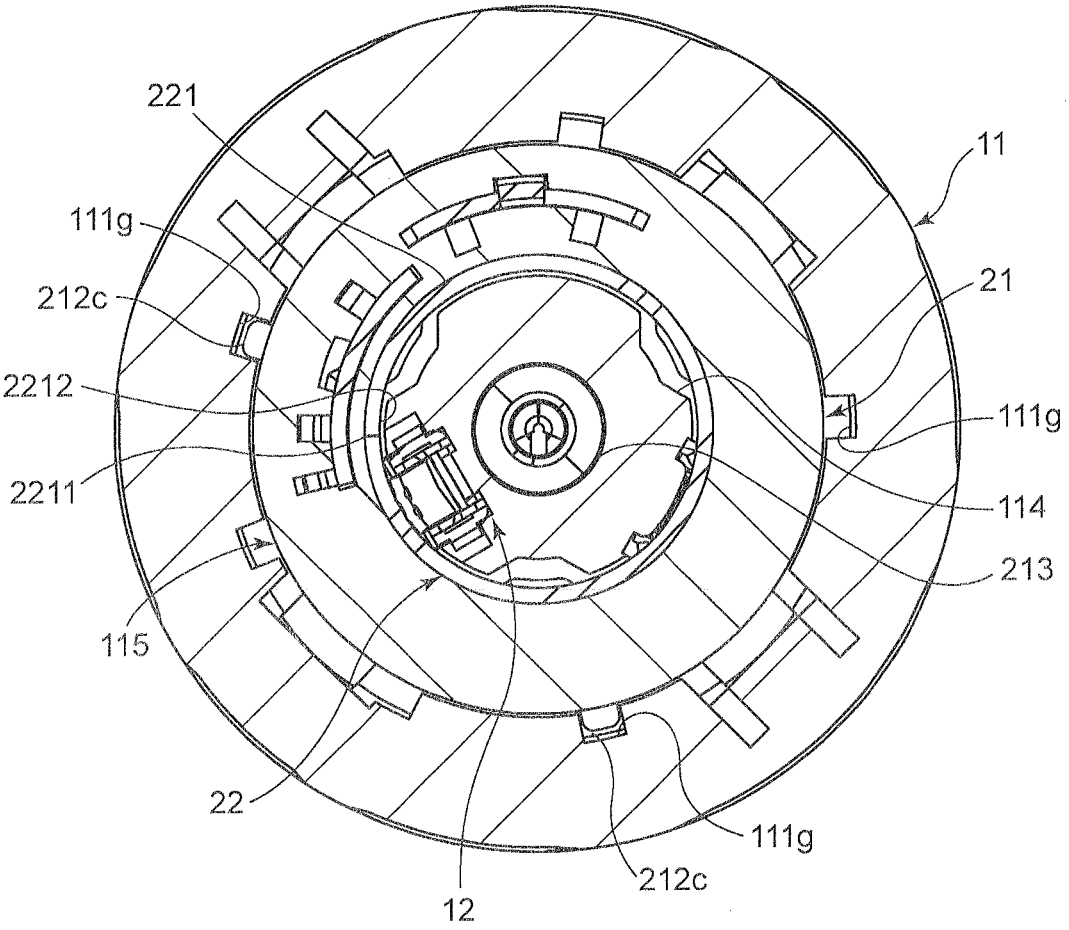
FIG. 17 is a cross-sectional view showing a state where the first connector terminal and the second connector terminal illustrated in FIG. 14 are fitted with each other.
Figure 19:
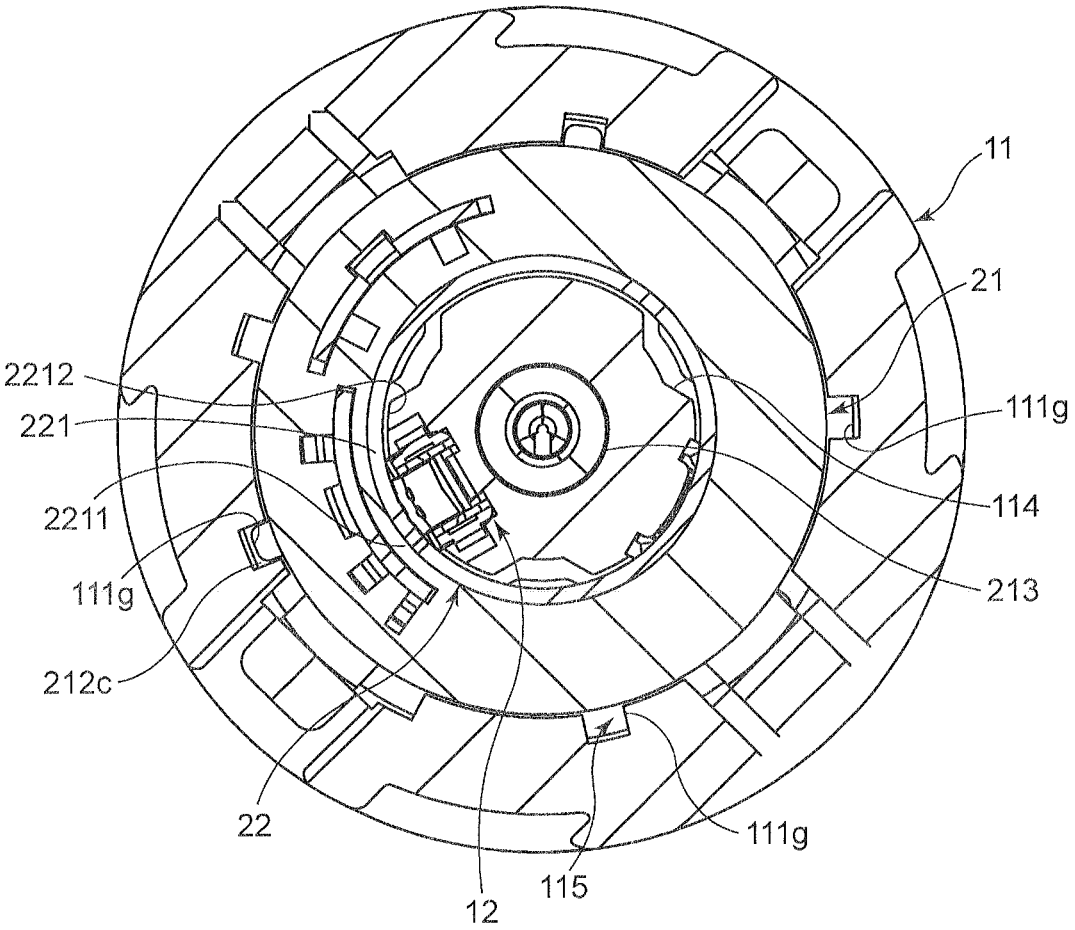
FIG. 19 is a partially enlarged cross-sectional view showing a state sifted from the state where the first connector terminal and the second connector terminal are fitted with each other in FIG. 18.
Figure 20:
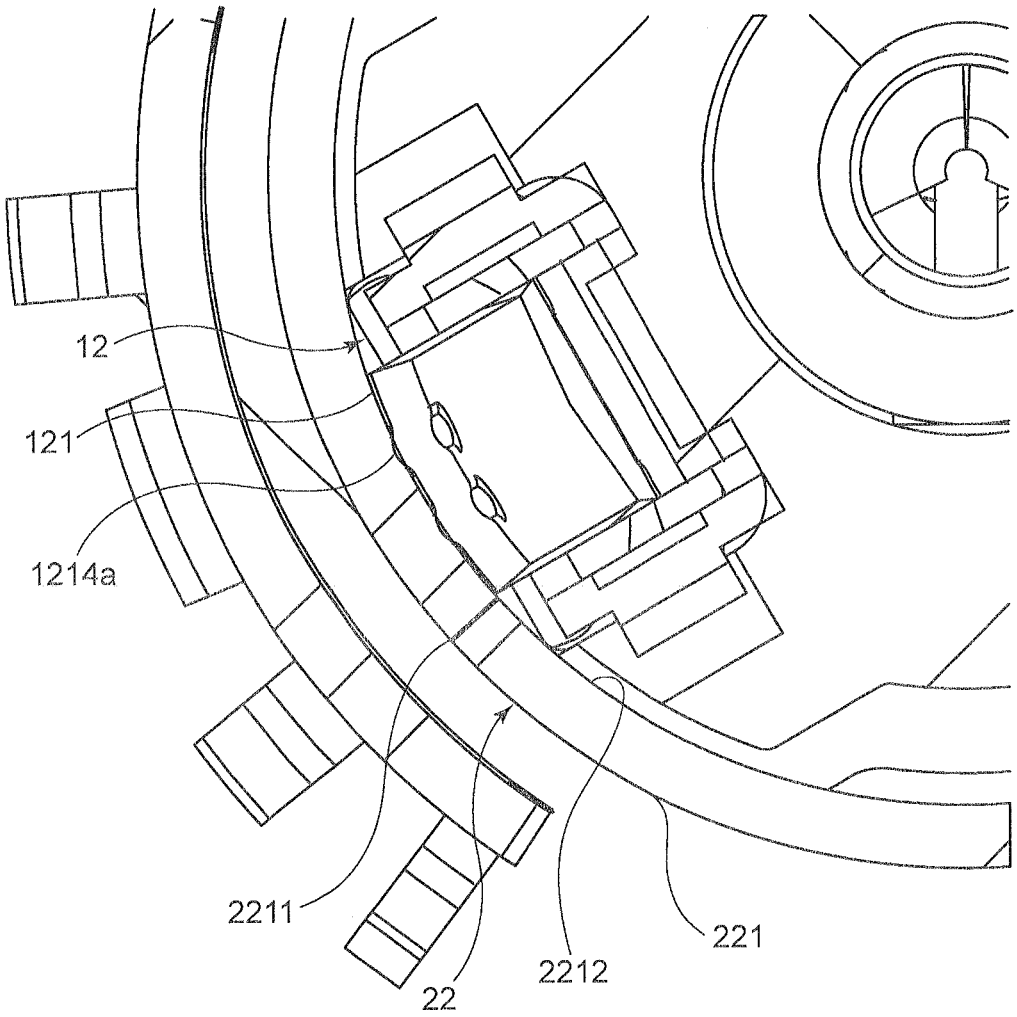
FIG. 20 is a partial cross-sectional view showing a contacting state between the first connector terminal in FIG. 3 illustrated in FIG. 3 and the first cylindrical terminal illustrated in FIG. 12.

As illustrated in FIGS. 17 and 19, the above-mentioned positioning unit is constituted of: the linear grooves 111*g* of the outer housing 11; and the linear projections 212*c* of the inner housing 21.

As mentioned before, when the peripheral wall part 212 illustrated in FIG. 10 is inserted only at a front half thereof into the first fitting hole 115 of the outer housing 11, the linear projections 212*c* of the inner housing 21 have not yet been fit into the linear grooves 111*g* of the outer housing 11. Thus, the outer and inner housings 11 and 21 can be fit into each other while rotating one of them 11 and 21 relative to the other.

As illustrated in FIG. 17, after the linear projections 212*c* have been fit into the linear grooves 111*g*, the outer and inner housing 11 and 21 are positioned with respect to a rotative direction, and hence, they cannot rotate around an axis thereof relative to each other.

The linear projections 212*c* and the linear grooves 111*g* cause the elastic contact pieces 121 of the first contact terminals 12 to contact the contact surface 2212 other than the joint portion 2211.

Figure 18:
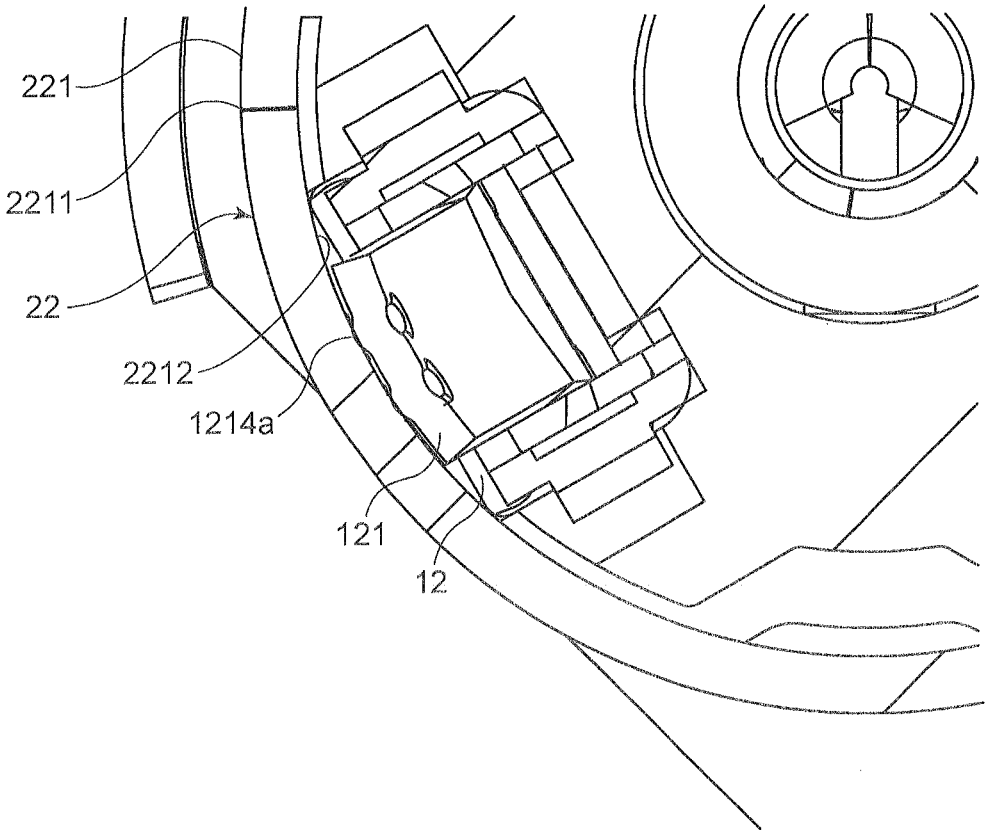
FIG. 18 is a partially enlarged cross-sectional view showing a state where the first connector terminal and the second connector terminal illustrated in FIG. 15 are fitted with each other.

In FIGS. 17 and 18, the first contact terminal 12 located at an open end of the first shaft 114 (of the first electrical connector 10) contacts the first cylindrical terminal 22 located at the deepest position of the second fixing hole 211.

As illustrated in FIGS. 10 and 11, the three linear projections 212*c* are arranged on the outer peripheral surface 212*a* of the inner housing 21 by 120 peripheral degrees. As illustrated in FIG. 2, the five linear grooves 111*g* are formed at an inner surface of the first fitting hole 115 of the outer housing 11. Accordingly, the outer and inner housings 11 and 21 can be fit into each other when the three linear projections 212*c* of the inner housing 21 are aligned with three of the five linear grooves 111*g* of the outer housing 11.

In FIGS. 17 and 18, the joint portion 2211 (of the first cylindrical terminal 22) is located close to one side (a left side in FIG. 17) of the first contact terminal 12, and the projections 1214*a* of the elastic contact piece 121 contact the contact surface 2212 of the first cylindrical terminal 22.

The outer housing 11 is rotated in a counter-clockwise direction by 40 degrees, which is an angular interval between the adjacent linear grooves 111*g*, relative to the condition illustrated in FIG. 17. Since the first contact terminal 12 is housed in the terminal space R2 of the outer housing 11, the first contact terminal 12 is rotated together with the outer housing 11.

Alternatively, the inner housing 21 is rotated in a clockwise direction by 40 degrees. Since the cylindrical terminal 22 is fixed to the inner housing 21, the first cylindrical terminal 22 is rotated together with the inner housing 21.

The rotated linear projection 212*c* is fit into one (the right one in FIG. 17) of the linear grooves 111*g* (See, FIGS. 19 and 20.) located adjacent to another of the linear grooves 111*g* into which the linear projection 212*c* has been fit in FIG. 17.

Due to the rotation, the linear projection 212*c* moves between the one and the other of the linear grooves 111*g*, and the joint portion 2211 of the first cylindrical terminal 22 moves over the projection 1214*a* of the first contact terminal 12.

This is because an angular interval between the adjacent linear grooves 111*g* around the central axis L1 (See, FIG. 1.) of the outer housing 11 is set greater than an angle covering the joint portion 2211 (See, FIG. 12.) of the first cylindrical terminal 22 around the central axis L2 (See, FIG. 10.) of the inner housing 21.

Since the joint portion 2211 is formed by joining the opposite ends 2211*a* and 2211*b* of the contact portion 221 to each other, a step in the joint portion 2211 may be formed.

However, since the linear projections 212*c* and the linear grooves 111*g* act as the positioning unit, even if the first electrical connector 10 is fit into the second electrical connector 20 at any peripheral position, the first contact terminals 12 do not contact the joint portion 2211 of the first cylindrical terminal 22 after the linear projections 212*c* has been fit into the linear grooves 111*g*. Accordingly, it is possible to prevent the elastic contact piece 121 of the first contact terminal 12 from contacting the joint portion 2211 of the first cylindrical terminal 22 to thereby be damaged and/or worn out. Thus, the first and second electrical connectors 10 and 20 ensure high reliability to the connection therebetween.

Furthermore, since the linear projections 212*c* and the linear grooves 111*g* are arranged radially around the central axis L2 of the outer and inner housings 11 and 21, even if the outer and inner housings 11 and 21 are fit into each other with one of them being in rotation, they can be fit into each other such that the linear projections 212*c* and the linear grooves 111*g* align with each other.

How the contact terminal 12 contacts the first cylindrical terminal 22 is explained hereinbelow with reference to FIGS. 21 and 22.

Figure 21:
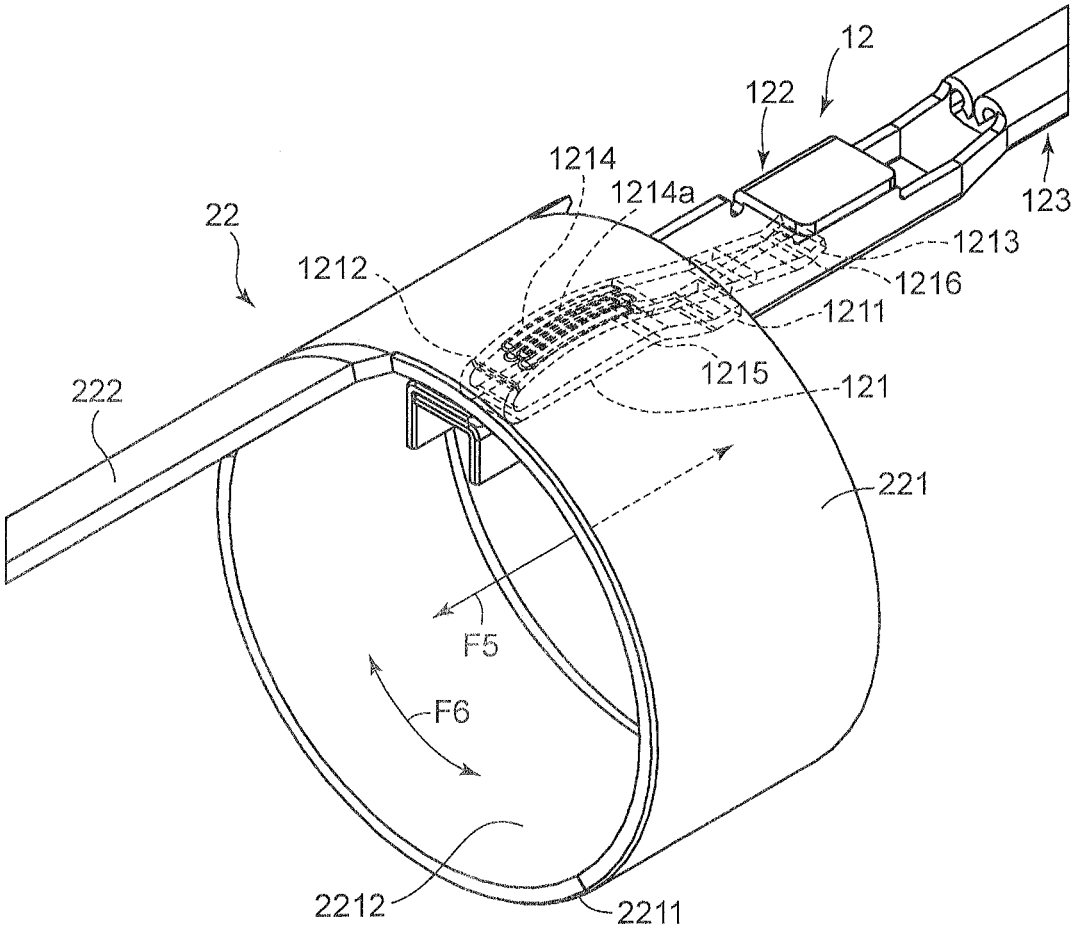
FIG. 21 is a perspective view showing a contacting state between the first connector terminal in FIG. 3 illustrated in FIG. 3 and the first cylindrical terminal illustrated in FIG. 12.

As illustrated in FIG. 21, in a situation in which the first and second electrical connectors 10 and 20 are fit into each other, the contact terminal 12 of the first electrical connector 10 contacts the first cylindrical terminal 22 arranged on an inner surface of the second fixing hole 211 formed in the second electrical connector 20.

The elastic contact piece 121 of the contact terminal 12 is arranged along an axial direction F5 of the first cylindrical terminal 22. In other words, the elastic contact piece 121 contacts the first cylindrical terminal 22 in a direction perpendicular to a peripheral direction of the arc contact surface 2212. Accordingly, even if the contact surface 2212 does not have a uniform curvature, the elastic contact piece 121 can stably contact the contact surface 2212.

Figure 22:
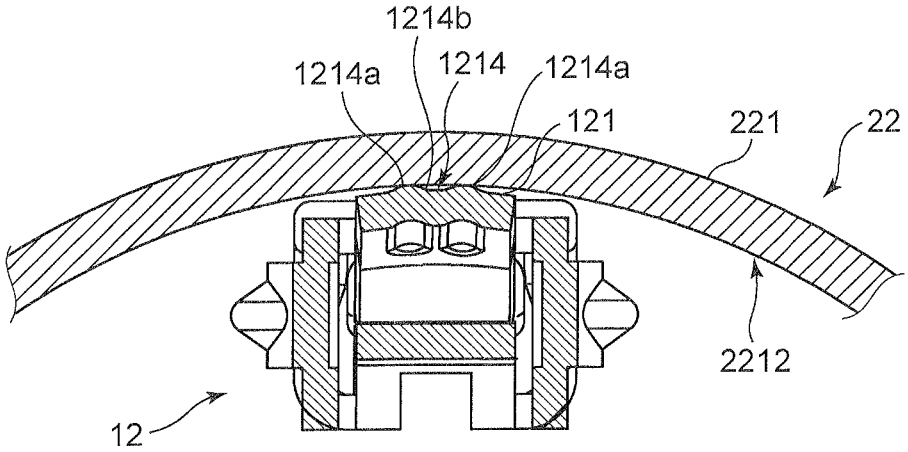
FIG. 22 is a partial cross-sectional view showing a contacting state between the first connector terminal and the first cylindrical terminal illustrated in FIG. 21.

As illustrated in FIG. 22, the contact portion 1214 of the elastic contact piece 121 is designed to have an arc surface extending in a cross-section perpendicular to the axial direction F5 (See, FIG. 21.) of the first cylindrical terminal 22, and along the arc contact surface 2212 of the contact portion 221. Thus, the contact portion 1214 and the contact surface 2212 are both designed to be arc corresponding to each other, they can further stably contact each other.

A plurality of the projections 1214*a* is formed on an outer surface of the contact portion 1214 in a peripheral direction F6 of the contact portion 221. As illustrated in FIG. 21, each of the projections 1214*a* is designed to be elongate and to extend in the length-wise direction F5 of the first cylindrical terminal 22.

For instance, it is assumed that the elastic contact piece 121 is designed not to include the projections 1214*a* on an outer surface of the contact portion 1214, and accordingly, the contact portion 1214 directly contacts at an outer surface thereof the arc contact surface 2212 of the first cylindrical terminal 22. In such a case, the contact portion 1214 of the elastic contact piece 121 may be designed to have an arc outer surface along the arc contact surface 2212, ensuring enlargement in an area at which the contact surface 2212 and the contact portion 1214 contact each other.

If the contact surface 2212 and the contact portion 1214 do not have a uniform curvature, they merely unstably contact each other.

However, since the contact portion 1214 is designed to possess a plurality of the projections 1214*a*, even if the arc contact surface 2212 of the first cylindrical terminal 22 and the arc outer surface of the contact portion 1214 do not have a uniform curvature, the elastic contact piece 121 can contact the first cylindrical terminal 22 at two or more points. Thus, the first contact terminal 12 can stably contact the first cylindrical terminal 22, ensuring high contact reliability.

Since the projections 1214*a* extend in the length-wise direction F5 of the first cylindrical terminal 22, that is, since the projections 1214*a* contacts the arc contact surface 2212 in a direction perpendicular to the peripheral direction of the arc contact surface 2212, even if the arc contact surface 2212 does not have a uniform curvature, the non-uniform curvature of the arc contact surface 2212 does not exert harmful influence on the contact of the projections 1214*a* with the arc contact surface 2212.

The projections 1214*a* are equally spaced away from one another in a peripheral direction thereof around a top 1214*b* (See, FIG. 22.) of the contact portion 1214. Accordingly, each of the projections 1214*a* uniformly contacts the arc contact surface 2212 of the first cylindrical terminal 22, ensuring that the projections 1214*a* can stably contact the contact surface 2212.

Hereinbelow is explained how the contact terminal 12 acts when the contact terminal 12 is inserted into the terminal space R2 of the outer housing 11.

Figure 5:
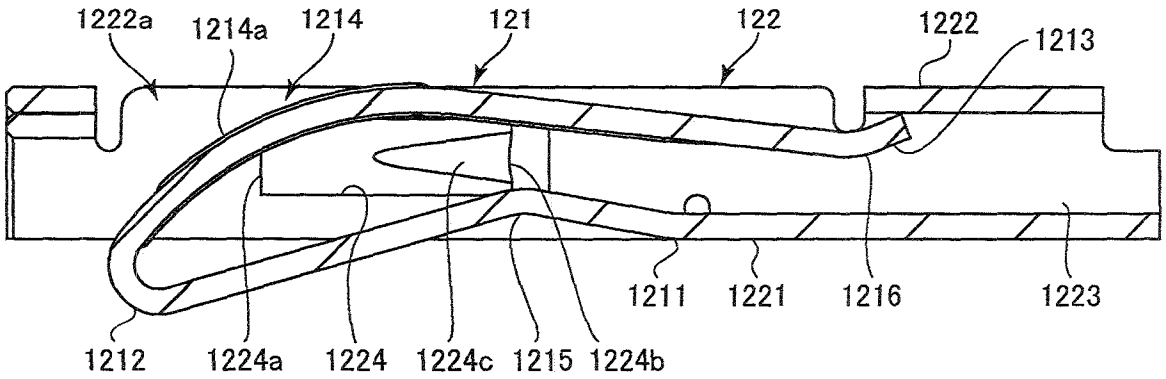
FIG. 5 is a partial cross-sectional view of the connector terminal illustrated in FIG. 4.
Figure 6:
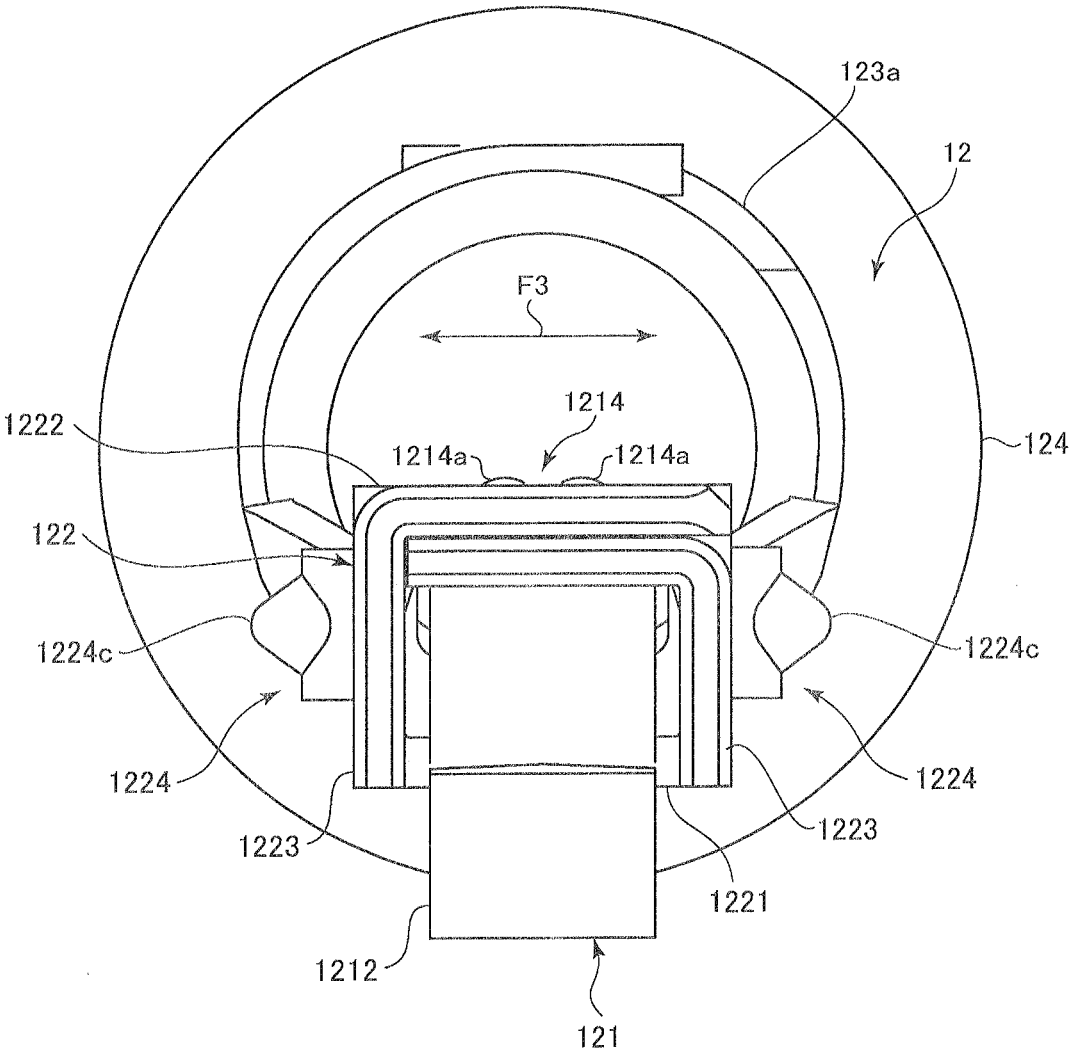
FIG. 6 is a front view of the connector terminal illustrated in FIG. 3.
Figure 7:
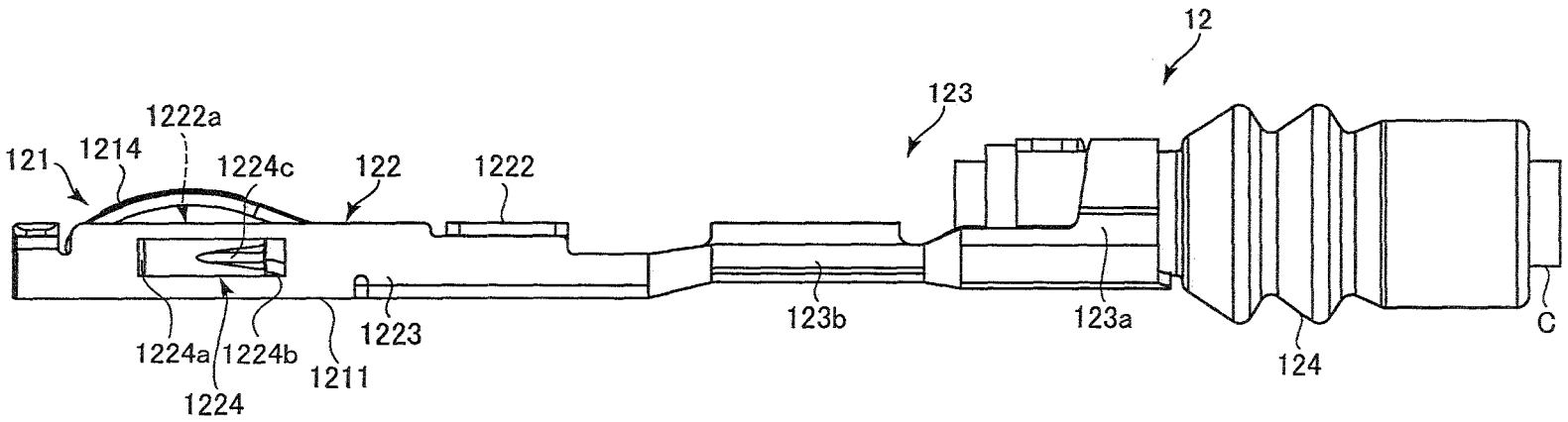
FIG. 7 is a side view of the connector terminal illustrated in FIG. 4, showing that the elastic contact piece is lifted up, resulting in that the elastic contact piece projects out of a terminal body.
Figure 8:
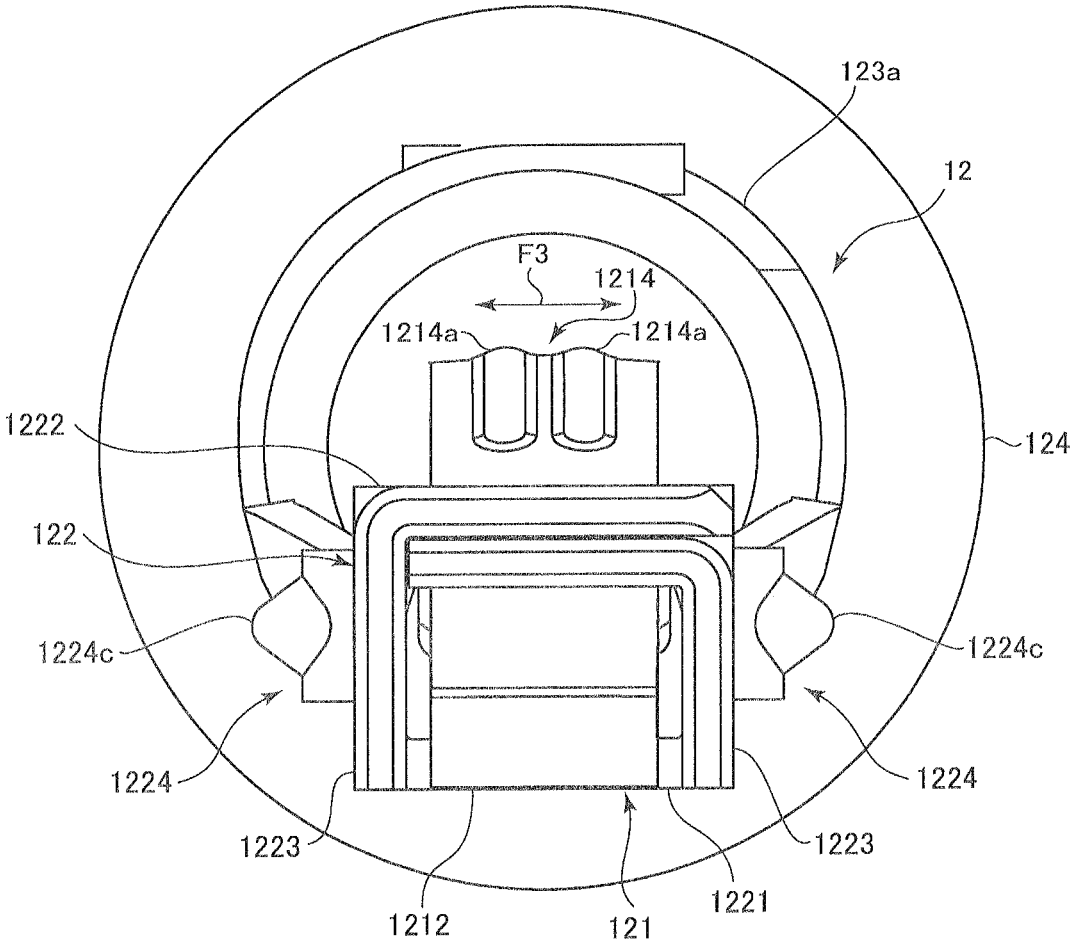
FIG. 8 is a front view of the connector terminal illustrated in FIG. 7.

As illustrated in FIGS. 4 and 5, when the contact terminal 12 is not inserted into the terminal space R2, the folded portion 1212 projects out of the bottom wall 1221 of the first terminal body 122.

Figure 23A:
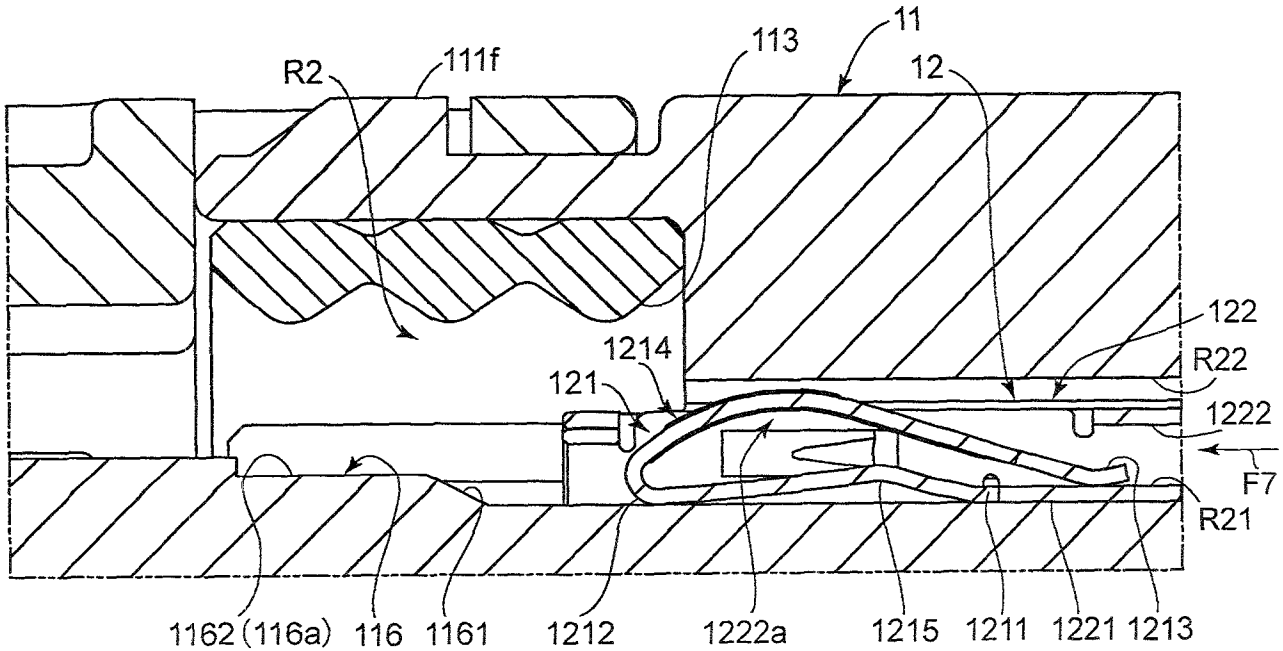
FIG. 23A is a partial cross-sectional view of a terminal space into which the connector terminal illustrated in FIG. 3 is inserted.

The contact terminal 12 in such a condition as illustrated in FIG. 14 is inserted into the terminal space R2 through a rear end of the outer housing 11. As illustrated in FIG. 23A, being inserted into the terminal space R2, the folded portion 1212 of the elastic contact piece 121 is pushed up by a floor R21 of the terminal space R2, and the folded portion 1212 slides on the floor R21 of the terminal space R2. In the situation illustrated in FIG. 23A, since the folded portion 1212 contacts the floor R21 of the terminal space R2, the contact part 1214 of the elastic contact piece 121 is still located relatively low although it is slightly pushed up. Specifically, the contact part 1214 is partially exposed out of the opening 1222*a* (See, FIG. 5.), but not wholly exposed out of the opening 1222*a*, that is, almost of the contact part 1214 is still housed in the first terminal body 122.

Figure 23B:
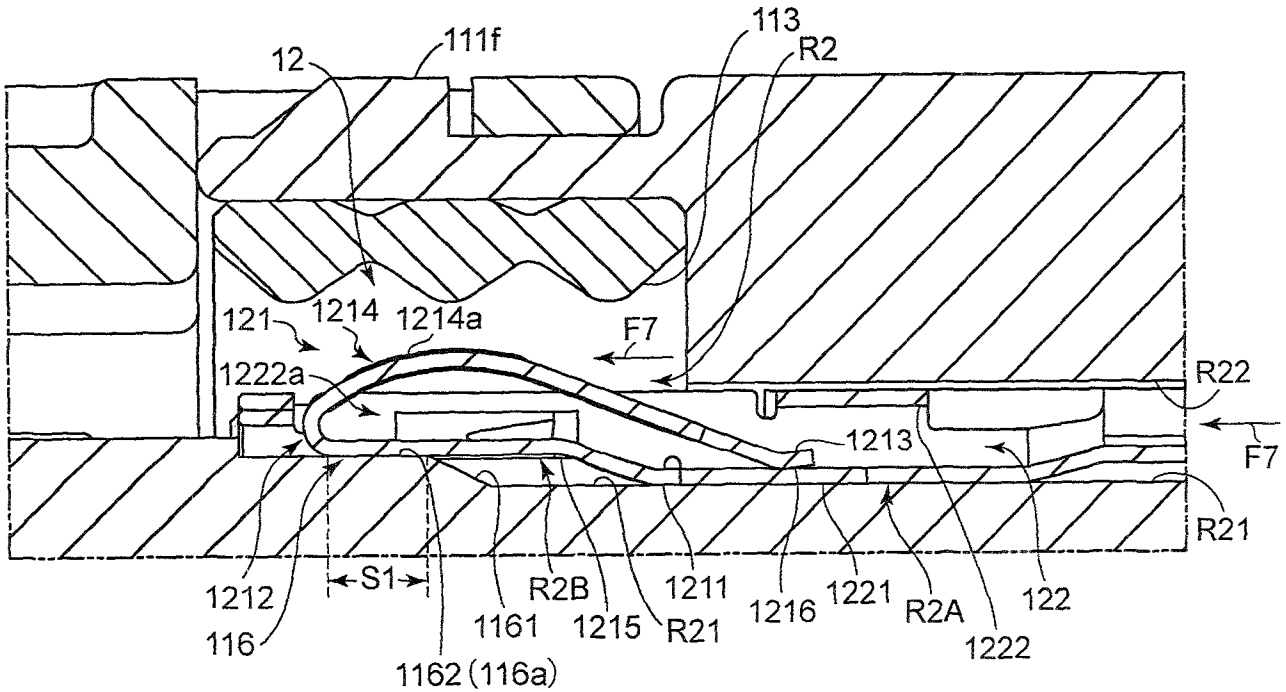
FIG. 23B is a partial cross-sectional view of a terminal space in which the elastic contact piece runs onto a raised portion next to FIG. 23A.

When the contact terminal 12 is further inserted into the terminal space R2, as illustrated in FIG. 23B, the folded portion 1212 runs onto a raised portion 116 formed on the floor R2 of the terminal space R2.

The raised portion 116 includes: a slope 1161 inclining ascending in a direction F7 in which the contact terminal 12 is inserted into the terminal space R2; and a horizontal portion 1162 continuous with a top of the slope 1161.

Running onto the raised portion 116, the folded portion 1212 is directed further upwardly. Thus, the contact part 1214 of the elastic contact piece 121 projects out of the opening 1212*a*. As the folded portion 1212 stands up, the free second end 1213 of the elastic contact piece 121 lowers towards the bottom wall 1221 of the first terminal body 122, and abuts on the bottom wall 1221. Thus, the second end 1213 acts as a fulcrum to support the elastic contact piece 121.

As a result that the second end 1213 and accordingly the second curved portion 1216 abuts on the bottom wall 1221, the folded portion 1212 and the second end 1213 (or the second curved portion 1216) wholly support the elastic contact piece 121 therewith. Consequently, when the contact part 1214 contacts the first cylindrical terminal 22 to thereby be loaded, the load is divided by the folded portion 1212 and the second curved portion 1216. Thus, it is possible to prevent the folded portion 1212 from being plastically deformed due to the load exerted onto the contact part 1214, ensuring that a contact load with which the contact part 1214 contacts the first cylindrical terminal 22 can be increased.

Furthermore, since the free second end 1213 abuts on the bottom wall of the first terminal body 122, a length of the elastic contact piece 121 between the contact part 1214 and the second end 1213 can be designed to be an allowable length within the first terminal body 122. Accordingly, the elastic contact piece 121 can have a sufficiently long spring length, the elastic contact piece 121 can accomplish enhanced spring performance. In addition, the elastic contact piece 121 can be a spring shape difficult to be plastically deformed.

Since the second end 1213 is continuous to the second curved portion 1216, the bottom wall 1221 is not hurt when the second end 1213 abuts on the bottom wall 1221. Furthermore, since the second curved portion 1216 slides on the bottom wall 1221, the second curved portion 1216 can smoothly move on the bottom wall 1221.

As mentioned above, the contact part 1214 of the elastic contact piece 121 is kept not projected out of the opening 1222*a* until the elastic contact piece 121 runs onto the raised portion 116 after the first contact terminal 12 has been inserted into the terminal space R2.

When the folded portion 1212 runs onto the raised portion 116, the contact part 1214 projects out of the opening 1222*a*, and thus, is exposed out of the first terminal body 122.

The first curved portion 1215 formed between the first end 1211 and the folded portion 1212 directs the folded portion 1212 towards the bottom wall 1211. That is, the first curved portion 1215 acts as an angle changer changing an angle by which the elastic contact piece 121 is bent. A direction in which the elastic contact piece 121 extends between the first end 1211 and the angle changer 1215 is different from a direction in which the elastic contact piece 121 extends between the angle changer 1215 and the folded portion 1212. When the folded portion 1212 runs onto the raised portion 116, the first curved portion 1215 changes an angle by which the folded portion 1212 is bent relative to the first end 1211, and hence, a portion of the elastic contact piece 121 between the first curved portion 1215 and the first end 1211 can be deformed.

A portion of the elastic contact piece 121 between the first curved portion 1215 and the first end 1211 obliquely ascend towards the opening 1222*a*, and the first curved portion 1215 directs the folded portion 1212 downwardly towards the bottom wall 1221. Thus, even if the folded portion 1212 is located at the same height as the raised portion 116, the portion of the elastic contact piece 121 between the first curved portion 1215 and the first end 1211 can be deformed, and the first curved portion 1215 can be widened, resulting in that the first contact terminal 12 can be housed in the terminal space R2 while the portion of the elastic contact piece 121 between the first curved portion 1215 and the folded portion 1212 is deformed.

Accordingly, it is possible to prevent the elastic contact piece 121 from being damaged and/or deformed while the first contact terminal 12 is being inserted into the outer housing 11, and further, the first contact terminal 12 can keep a sufficient contact pressure after having been inserted into the outer housing 11.

When the first contact terminal 12 is not inserted into the terminal space R2, the first curved portion 1215 has a curvature to direct the folded portion 1212 towards the bottom wall 1221. The elastic contact piece 121 possesses an area S1 (See, FIG. 23B.) in which the folded portion 1212 lies on the horizontal portion 1162 (a top face 116*a*) of the raised portion 116 when the folded portion 1212 runs onto the raised portion 116. The top face 116*a* of the raised portion 116 is formed to be flat, and the area S1 of the elastic contact piece 121 is formed in a shape of a plate. Thus, the elastic contact piece 121 can closely contact at the area S1 with the top face 116*a* of the raised portion 116, because the area S1 is in parallel with the top face 116*a* when the folded portion 1212 runs onto the raised portion 116.

Since the folded portion 1212 lies on the top face 116*a* of the raised portion 116 through the flat area S1, when the contact part 1214 of the elastic contact piece 121 contacts the first cylindrical terminal 22 (See, FIG. 21.), the folded portion 1212 is supported on the horizontal portion 1612 with the contact pressure between the contact part 1214 and the first cylindrical terminal 22 being received uniformly and wholly by the area S1 of the folded portion 1212. Thus, it is possible to uniformly compress the contact part 1214 onto the first cylindrical terminal 22.

In this embodiment, the elastic contact piece 121 includes the first curved portion 1215 acting as an elasticity changer. Thus, a curved degree of the elastic contact piece 121 is reduced at a position where the first curved portion 1215 is formed. On the contrary, the curved degree of the elastic contact piece 121 may be increased instead.

Figure 24:
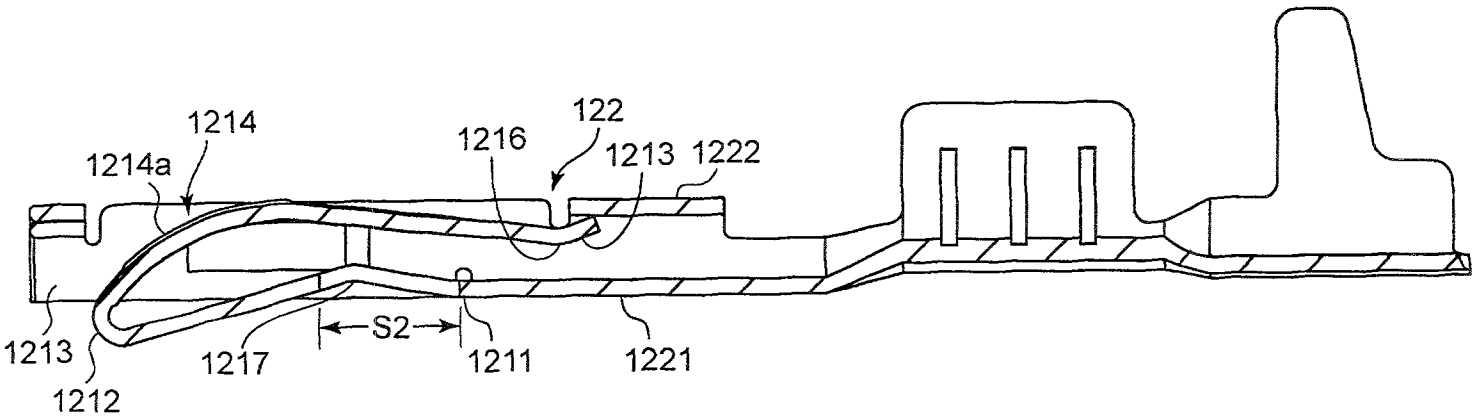
FIG. 24 is a side view of the connector terminal including an elastic contact piece according to a variant.
Figure 25:
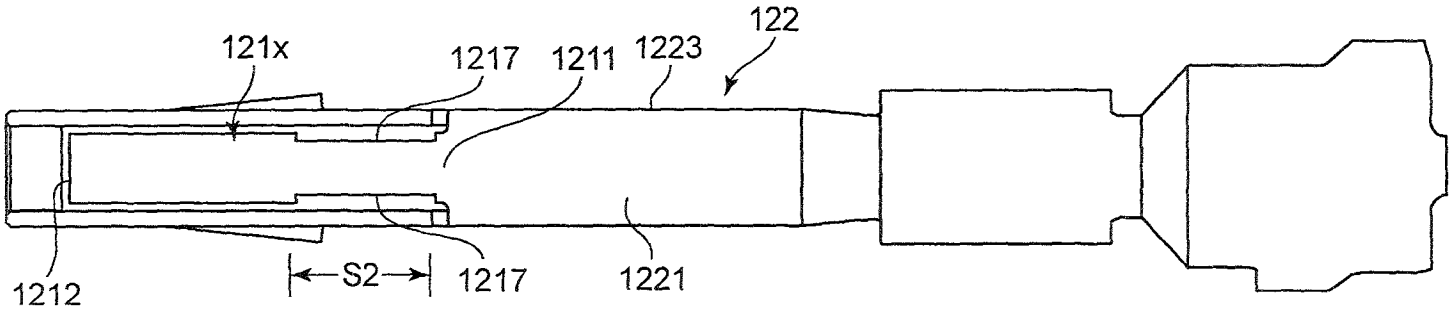
FIG. 25 is a bottom view of the connector terminal illustrated in FIG. 24 according to the variant.

An elastic contact piece 121*x* shown in FIGS. 24 and 25 includes a constricted portion 1217 acting as an elasticity changer. The constricted portion 1217 is formed by constricting both side edges of an area S2 (in a direction from the first end 1211 of the elastic contact piece 121*x* to the folded part 1212) in a shape of a rectangle.

By forming the constricted portion 1217, the constricted portion 1217 reduces a curved degree of the elastic contact piece 121 when the folded portion 1212 is lifted up by the raised portion 116 (See, FIG. 23B.). Thus, the elastic contact piece 121 can be deformed at a position where the constricted portion 1217 is formed.

Thus, even if the folded portion 1212 is located at the same height as the raised portion 116, since the elastic contact piece 121 is deformed, the first contact terminal 12 can be housed in the terminal space R2 while keeping the shape of the folded portion 1212.

Hereinbelow is explained how the lance 1224 acts when the first cylindrical terminal 12 is inserted into the terminal space R2.

The first contact terminal 12 is housed in the terminal space R2. As illustrated in FIGS. 23A and 23B, a first fitting hole R2A and a second fixing hole R2B are formed in the terminal space R2. The first fitting hole R2A is formed including: a floor R21 facing the bottom wall 1221 of the first terminal body 122; a ceiling R22 facing the top wall 1222; and sidewalls R23 in FIGS. 26 and 27 facing the sidewalls 1223. The second fixing hole R2B is located deeper than the first fitting hole R2A in a direction F7 in which the first contact terminal 12 is inserted into the terminal space R2. The second fixing hole R2B is vertically longer than the first fitting hole R2A, and is horizontally longer than the first fitting hole R2A.

The first contact terminal 12 first enters the first fitting hole R2A. The lance 1224 standing up from the sidewalls 1223 of the first terminal body 122 are compressed by a pair of the sidewalls R23 of the first fitting hole R2A facing each other, and thus, are kept deformed while the first contact terminal 12 is forwarding.

As illustrated in FIG. 27, when the first contact terminal 12 passes over the sidewalls R23 by which the lance 1224 is compressed, and arrives at the second fixing hole R2B, the lance 1224 is no longer compressed by the sidewalls R23, and hence, returns to an original form thereof. Thus, the lance 1224 gets wider than a gap between the first terminal body 122 and the sidewalls R23. Accordingly, even if the first contact terminal 12 is tried to be pulled out of the terminal space R2, the lance 1224 is caught by the sidewalls R23, and hence, the first contact terminal 12 is prevented from being pulled out of the terminal space R2.

The lance 1224 includes a projected portion 1224*c*. Between the sidewalls R23 of the terminal space R2 and the lance 1224 is formed gaps S0 through which the second portions 1224*n* can pass.

For instance, when the first contact terminal 12 is inserted into the terminal space R2, if the lance 1224 is compressed at proximal ends thereof by the sidewalls R23 of the terminal space R2, the lance 1224 is plastically deformed with the proximal ends thereof being closed, and accordingly, the lance 1224 cannot get wide. In such a condition, the first contact terminal 12 can be readily pulled out of the terminal space R2, if the cable C1 is strongly pulled.

However, since the gaps S0 through which the projected portions 1224*c* of the second slope portion 1224*n* can pass are formed between the sidewalls R23 of the terminal space R2 and the lance 1224, there can be ensured a sufficient gap between the first terminal body 122 and the sidewalls R23.

The gaps S0 causes the lance 1224 to contact the sidewalls R23 at a point P1 closer to an open end 1224*b* than a proximal end 1224*a* of the second slope portion 1224*n*. The gaps S0 formed between the first contact terminal 12 and the sidewalls R23 are designed to allow the sidewalls R23 to contact the lance 1224 at a point closer to the open end 1224*b* than a center of a full length of the lance 1224.

Accordingly, it is possible to maintain an elastic force by which the compressed lance 1224 wants to return to an original form thereof to thereby prevent the open ends 1224*a* of the lance 1224 from being plastically deformed. Thus, the lance 1224 can be engaged to the sidewalls R23 of the terminal space R2 by a sufficient length, ensuring it possible to prevent the first contact terminal 12 from being pulled out of the terminal space R2, even if the first contact terminal 12 is pulled backwardly.

Thus, the first contact terminal 12 can be kept inserted in the terminal space R2 of the outer housing 11, ensuring high reliability to electrical connection between the first contact terminal 12 and the first cylindrical terminal 22.

For instance, it is assumed that the lance 1224 is designed not to include the projected portion 1224*c*, and hence, the second slope portion 1224*n* inclines by a constant angle. If the lance 1224 is designed to be longer than the present one, the lance 1224 contacts the sidewalls R23 of the terminal space R23 at a location remoter from the first terminal body 122 when the sidewalls R23 contact the proximal end of the lance 1224. Thus, since a gap to be formed between the sidewalls R23 of the terminal space R2 and the first terminal body 122 can be wide, it is possible to prevent the sidewalls R23 from abutting on the proximal end of the lance 1224.

However, if the lance 1224 is designed to be longer, since the lance 1224 is housed in the second fixing hole R2B while contacting the sidewalls R23 in the first fitting hole R2A, it is necessary to forward the first contact terminal 12 by a distance by which the lance 1224 is made longer. Thus, it is necessary to fabricate the second fixing hole R2B to be longer.

However, the projected portions 1224*c* of the lance 1224 is formed such that an inclination angle between the first terminal body 122 and the open ends 1224*b* is greater than an inclination angle between the first terminal body 122 and the proximal end 1224*a* in the first contact terminal 12. Accordingly, even if gaps formed between the first terminal body 122 and the sidewalls R23 are wide, it is possible for the projected portion 1224*c* of the lance 1224 to engage with the sidewalls R23, and hence, it is not necessary to design the second fixing hole R2B to be long.

The projected portion 1224*c* of the non-compressed lance 1224 slide on and are compressed by the sidewalls R23 at an entrance to the terminal space R23. Each of the projected portions 1224*c* is formed such that a gap between each of the projection portions 1224*c* and each of the sidewalls 1223 is greater at a location closer to each of the open ends 1224*b*. Accordingly, as a location at which each of the sidewalls R23 contacts the lance 1224 transfers towards each of the open ends 1224*b* as the first contact terminal 12 forwards into the terminal space R2, the lance 1224 can be gradually closed along the above-mentioned gap between each of the projections portion 1224*c* and each of the sidewalls 1223. Thus, the first contact terminal 12 can be smoothly inserted into the terminal space R2 without the lance 1224 being interfered with the sidewalls R23

Furthermore, since each of the projected portions 1224*c* is formed such that a gap between each of the projections portion 1224*c* and each of the sidewalls 1223 is greater at a location closer to each of the open ends 1224*b*, it is possible for the open ends 1224*b* of the projected portions 1224*c* to have an enhanced resistance against being compressed and/or collapsed. Accordingly, it is possible to prevent the projected portions 1224*c* from being deformed due to a compressive force increasing as the first contact terminal 12 forwards into the terminal space R2, exerted onto the lance 1224 by the sidewalls R23.

Furthermore, since the lance 1224 is formed by forming a cutting line around a part of the sidewall 1223 of the first terminal body 122, and causing the pail: to outwardly stand, it is not necessary to attach any separate part to the first terminal body 122 for forming the lance 1224. Thus, the lance 1224 can be readily fabricated.

Figure 28:
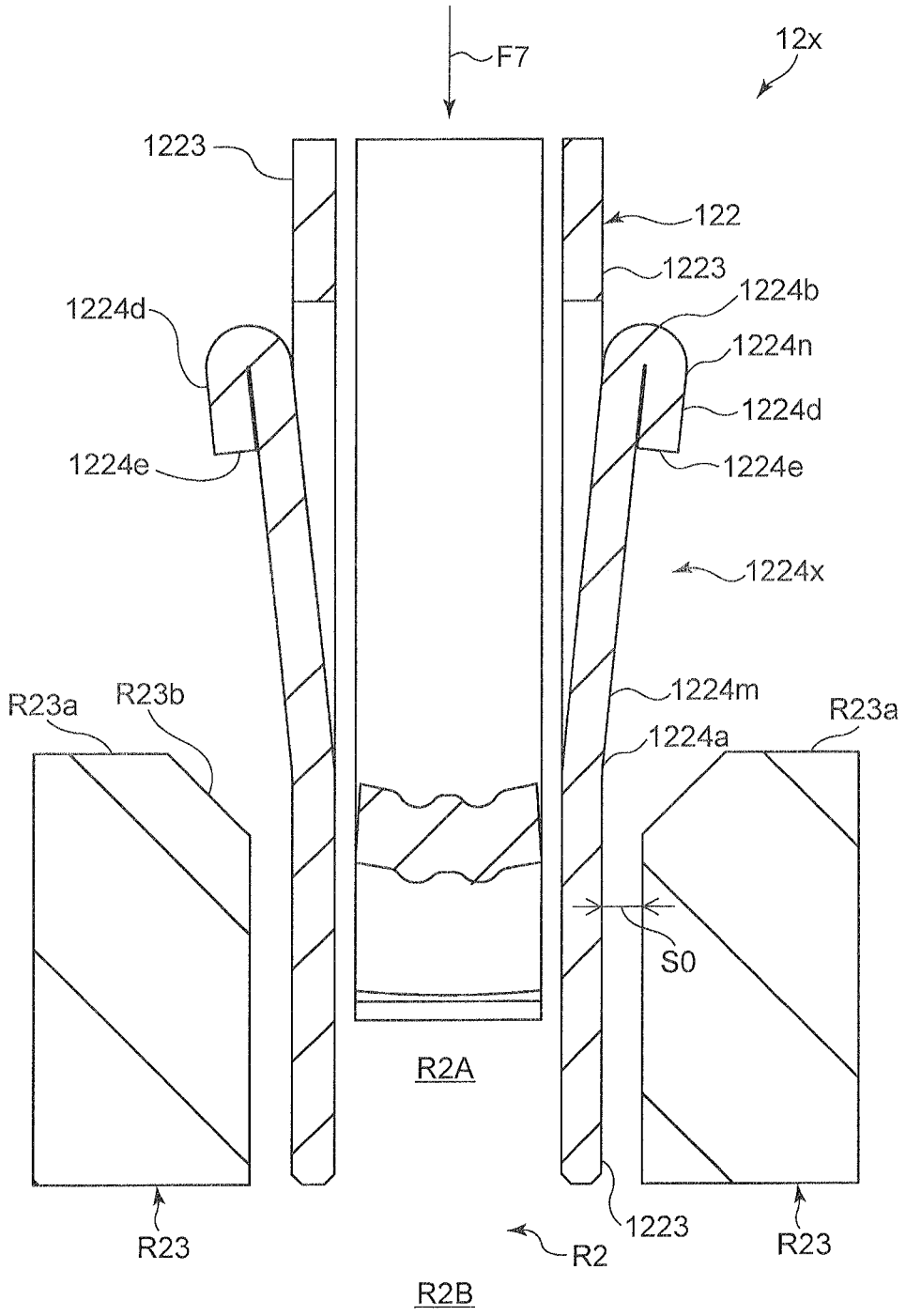
FIG. 28 is a partial cross-sectional view of the connector terminal illustrated in FIG. 3 according to a first variant, showing a state before being inserted into the terminal space.

The lance 1224 illustrated in FIGS. 27 and 28 is designed to include the projected portions 1224*c*. Instead of the projected portions 1224*c*, the lance 1224 may be designed to include folded portions formed by folding open end of the lance 1224.

Figure 29:
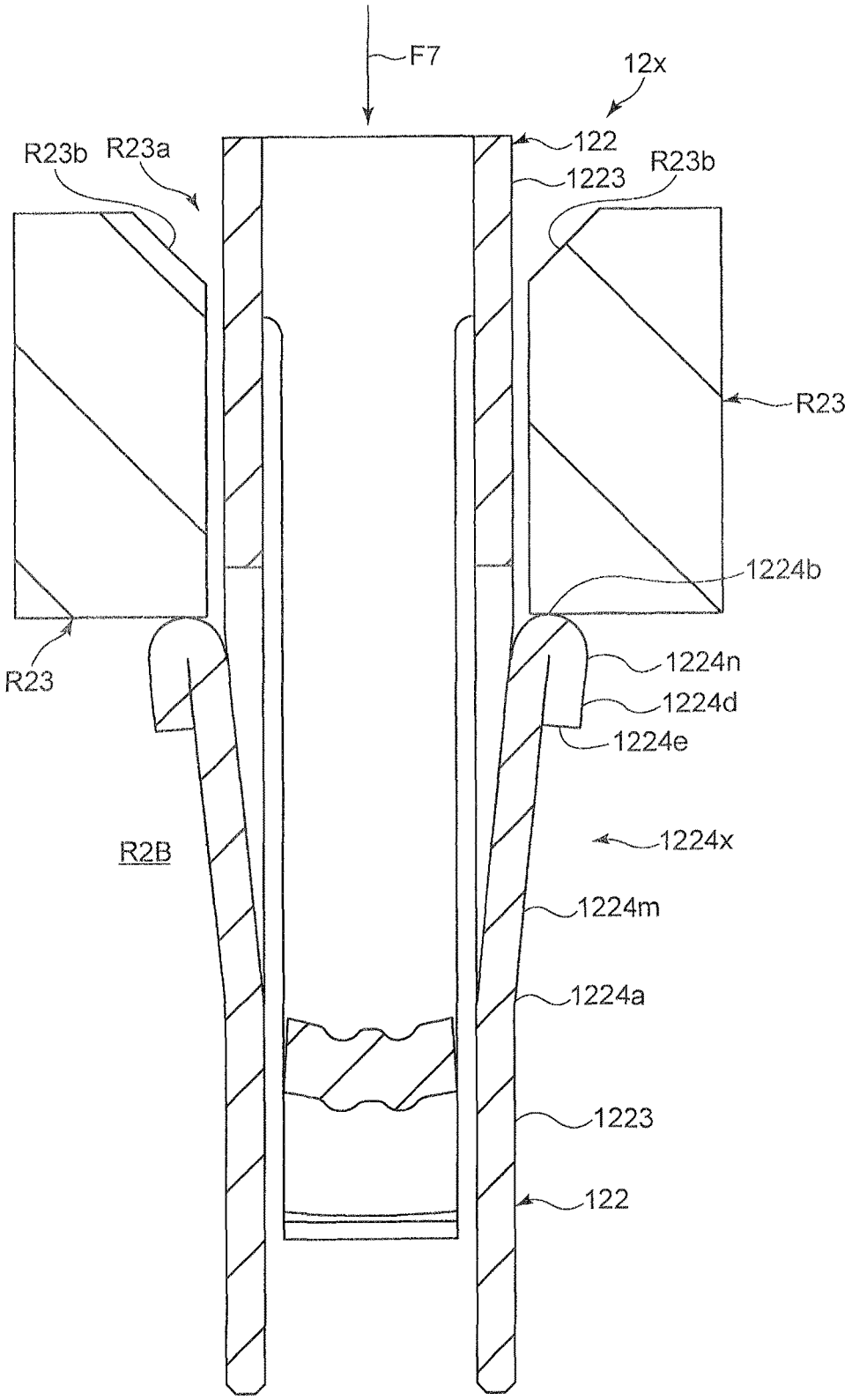
FIG. 29 is a partial cross-sectional view of the connector terminal, showing a state after having been inserted into the terminal space next to FIG. 28.

FIGS. 28 and 29 illustrate a lance 1224*x* including a folded portion formed by folding an open end of the lance, according to a first variant.

As illustrated in FIGS. 28 and 29, the lance 1224*x* includes: a first slope portion 1224*m* extending at the proximal end 1224*a* from the first terminal body 122; and a second slope portion 1224*n* constituted of a folded portion 1224*d* or a folded portion 1224*d* formed by outwardly folding a open end of the first portion 1224*n* into two layers stacking one on another. The lance 1224*x* is fabricated by forming a cut line around a portion of the sidewall 1223 of the first terminal body 122, and causing the portion to stand relative to the sidewall 1223.

Each of the folded portions 1224*d* is located outside of the first portions 1224*m* inclining relative to the sidewalls 1223 of the first terminal body 122. Accordingly, it is possible to form such a gap S0 between the first terminal body 122 of the first contact terminal 12*x* and each of the sidewalls R23 that the sidewalls R23 do not contact the proximal end 1224*a* of the lance 1224*x* when the first contact terminal 12*x* is inserted into the second fixing hole R2A.

In the first variant, the sidewalls R23 contact the lance 1224*x* at locations closer to the open ends 1224*b* than a center of the lance 1224*x* when the first contact terminal 12*x* is inserted into the terminal space R2. In FIG. 28, the sidewalls R23 contact the second portions 1224*n* of the lance 1224*x*. Accordingly, it is possible to maintain an elastic force by which the compressed lance 1224*x* wants to return to the original form thereof to thereby prevent the first contact terminal 12*x* from being pulled out of the terminal space R2, even if the first contact terminal 12*x* is pulled backwardly.

The folded portions 1224*d* make it possible for the lance 1224*x* to contact the sidewalls R23 at a location outside than an inclination angle of the first portions 1224*m*. Thus, even if the gaps S0 are formed wide, the lance 1224*x* can be engaged to the sidewalls R23 while the second fixing hole R2B is not fabricated longer.

Since the open end 1224*b* of the lance 1224*x* is outwardly folded to form the folded portions 1224*d*, end surfaces 1224*e* of the folded portions 1224*d* face end surfaces R23*a* of the sidewalls R23 to each other. On each of the end surfaces R23*a*, an inclined surface R23*b* for enlarging open ends of the sidewalls R23 is formed. Accordingly, it is possible to insert the lance 1224*x* into the first fitting hole R2A having a gradually reducing space therebetween while the folded portions 1224*d* slides on the inclined surfaces R23*b*.

In FIGS. 28 and 29, the inclines surfaces R23*b* are formed on the sidewalls R23. Alternatively, the inclines surfaces R23*b* may be formed on the end surfaces 1224*e* instead.

Figure 30:
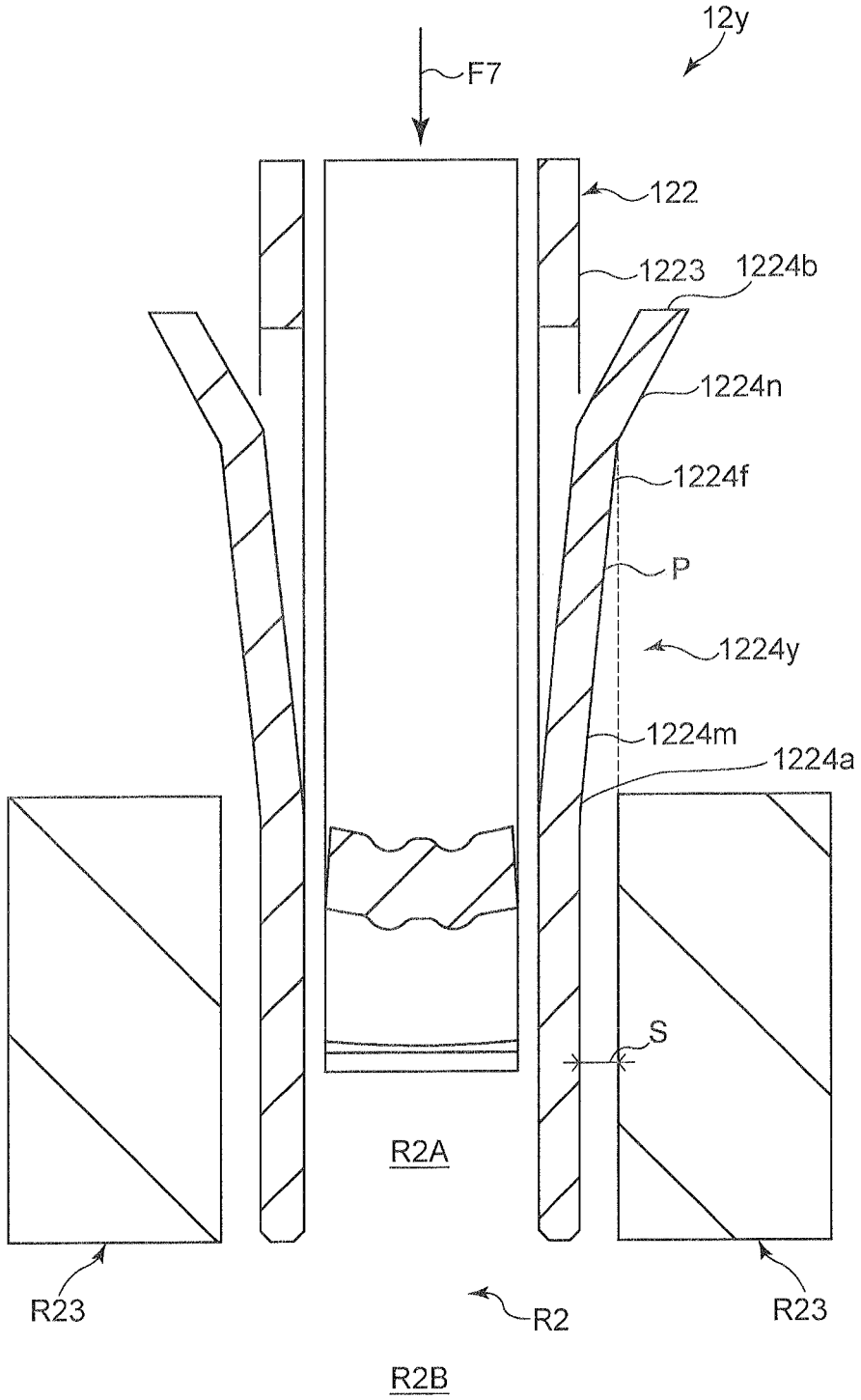
FIG. 30 is a partial cross-sectional view of the connector terminal illustrated in FIG. 3 according to the second variant, showing a state before being inserted into the terminal space.
Figure 31:
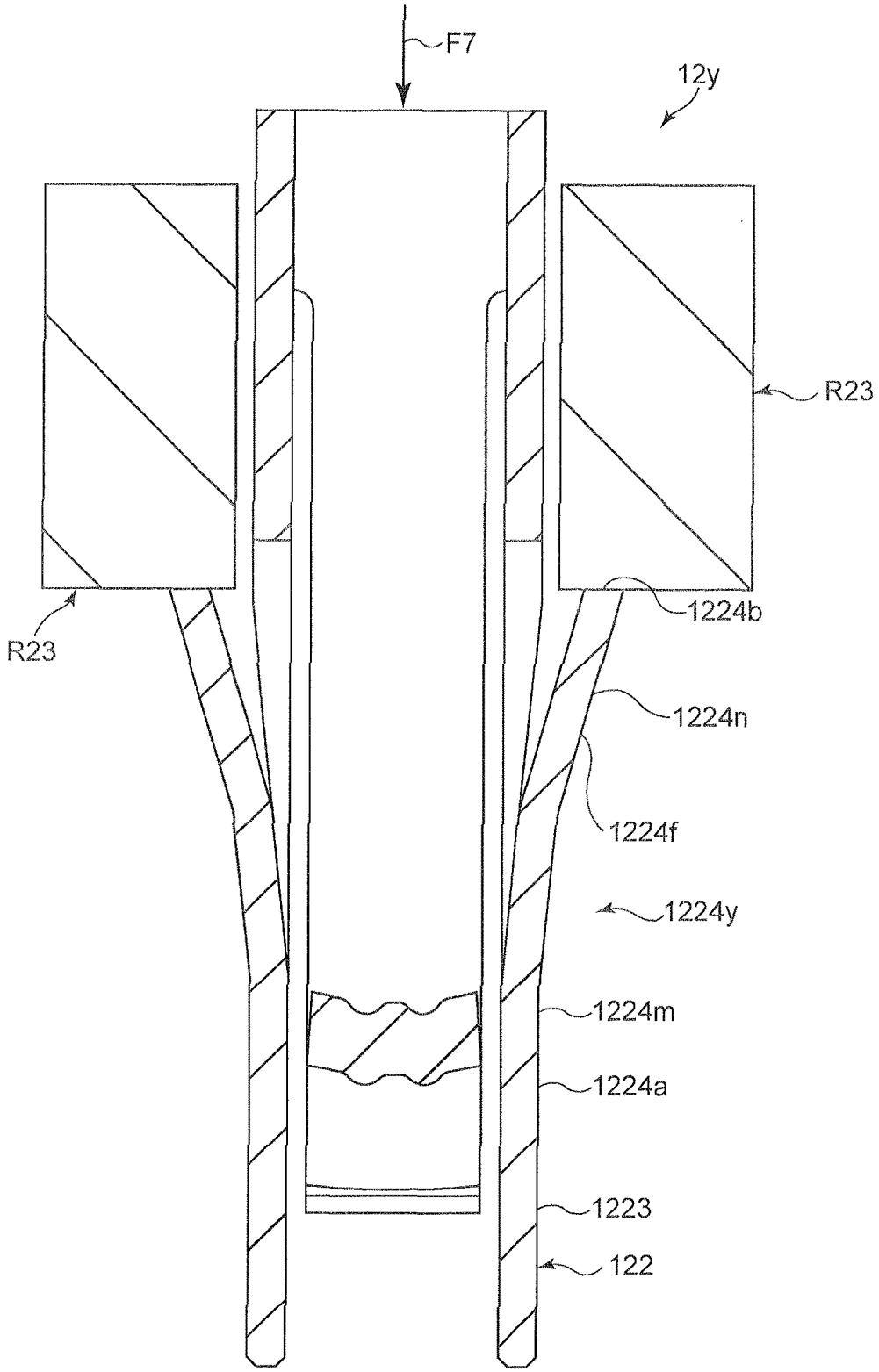
FIG. 31 is a partial cross-sectional view of the connector terminal, showing a state after having been inserted into the terminal space next to FIG. 30.
Figure 32:
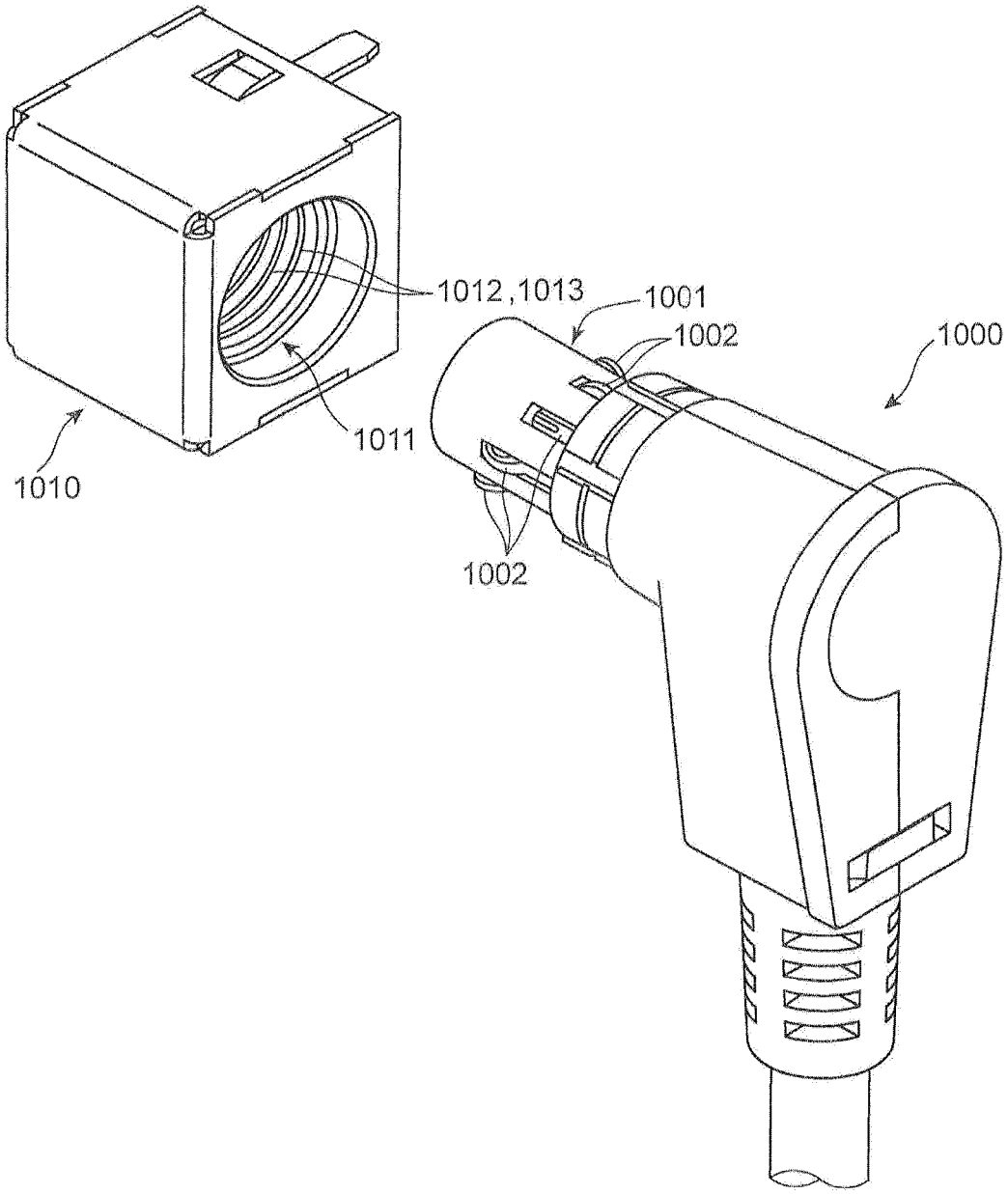
FIG. 32 PRIOR ART
FIG. 32 is a perspective view of a conventional electrical connector.
Figure 33:
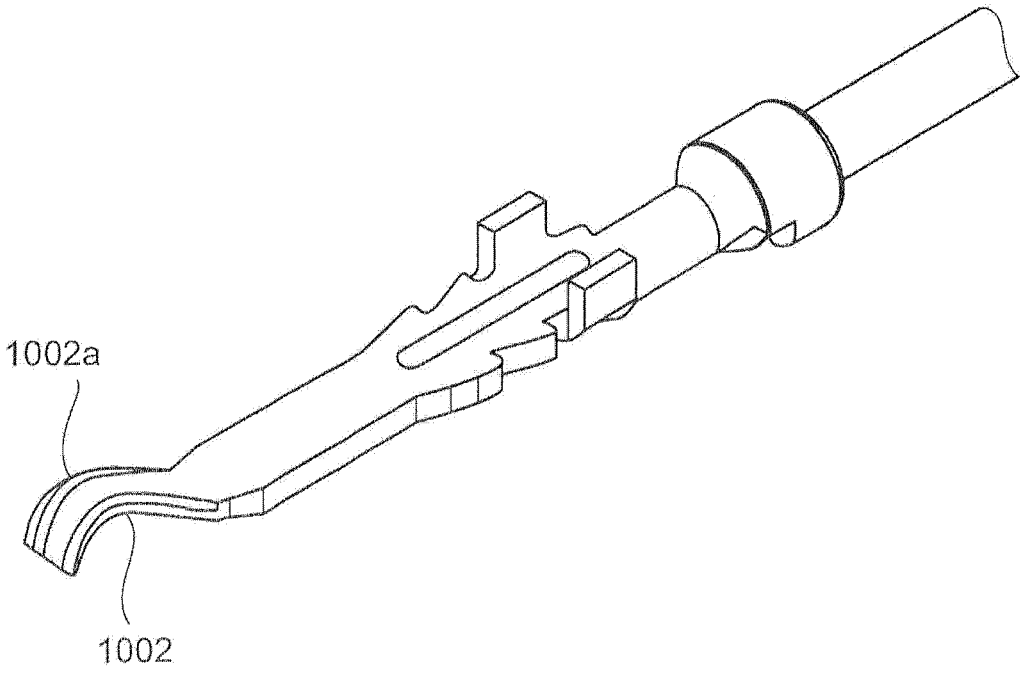
FIG. 33 PRIOR ART
FIG. 33 is a perspective view of a part of the electrical connector illustrated in FIG. 32.
Figure 34:
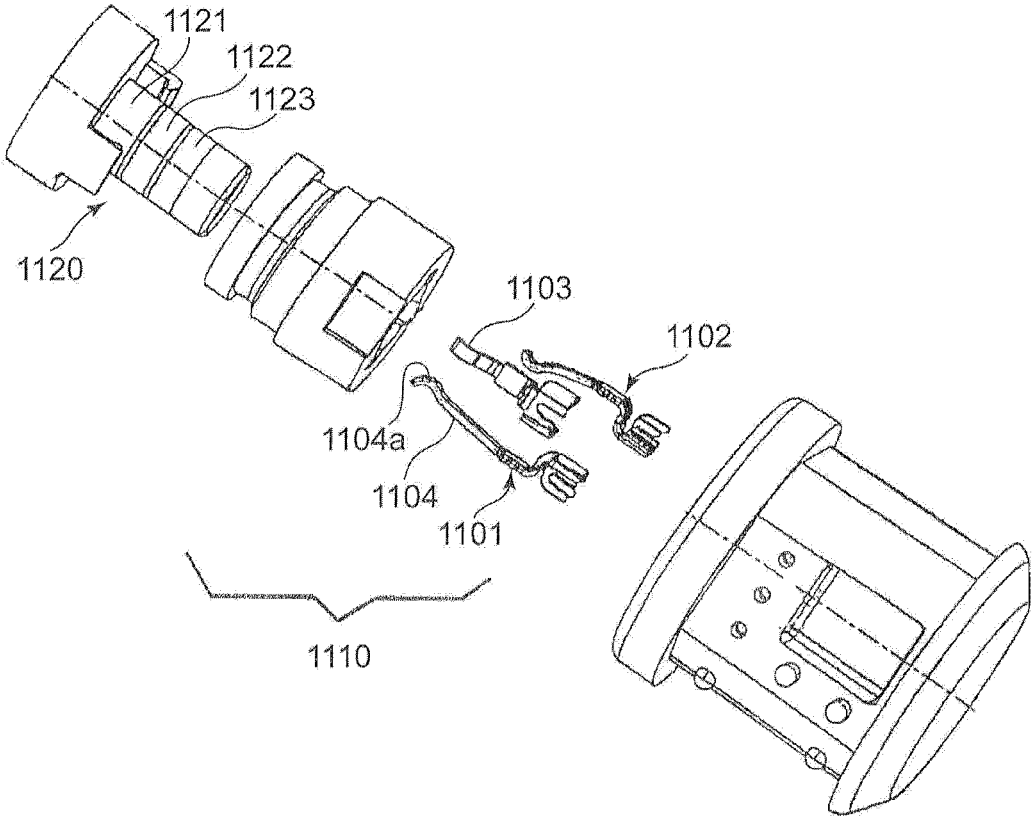
FIG. 34 PRIOR ART
FIG. 34 is a perspective view of another conventional electrical connector.

FIGS. 30 and 31 illustrate a lance 1224*y* according to a second variant. In the second variant, an inclining portion is formed by folding an open end of a lance of a contact terminal.

As illustrated in FIGS. 30 and 31, the lance 1224*y* includes: a first slope portion 1224*m* extending from the proximal end 1224*a*; and a second slope portion 1224*n* possessing an slope 1224*f* formed by outwardly bending the open end 1224*b*.

The slope 1224*f* formed by outwardly bending the open end 1224*b* is located outside than an inclination angle of the first portion 122*m*. Accordingly, it is possible to form such a gap S0 between the first terminal body 122 of the first contact terminal 12*y* and each of the sidewalls R23 that the sidewalls R23 do not contact the proximal end 1224*a* of the lance 1224*y* when the first contact terminal 12*y* is inserted into the second fixing hole R2A.

In the second variant, similarly to the first variant, the sidewalls R23 contact the lance 1224*y* at locations closer to the open ends 1224*b* than a center of the lance 1224*y* when the first contact terminal 12*y* is inserted into the terminal space R2. In FIG. 30, the sidewalls R23 contact the second portions 1224*n* of the lance 1224*y*. Accordingly, it is possible to maintain an elastic force by which the compressed lance 1224*y* wants to return to an original form thereof to thereby prevent the first contact terminal 12*y* from being pulled out of the terminal space R2, even if the first contact terminal 12*y* is pulled backwardly.

Furthermore, the slopes 1224*f* make it possible for the lance 1224*y* to contact the sidewalls R23 at a location outside than an inclination angle of the first portions 1224*m*. Thus, even if the gaps S0 are formed wide, the lance 1224*y* can be engaged to the sidewalls R23 while the second fixing hole R2B is not fabricated longer.

In the present embodiment, the first and second housings are defined as the outer and inner housing 11 and 21, respectively. Alternatively, the first and second housings are defined as the inner and outer housing 21 and 11, respectively.

INDUSTRIAL APPLICABILITY

The electrical connector according to the present invention can be used as a connector equipped in a glow plug, a connector for connecting a combustion pressure sensor and a wire harness to each other, a connector for connecting cables to each other, a connector equipped in various electric/electronic devices, and a connector equipped in an automobile. The electrical connector according to the present invention can be employed broadly in fields such as an electric/electronic industry and an automobile industry.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosures of Japanese Patent Applications No. 2014-252495 filed on Dec. 12, 2014 including specification, claims, drawings and summary are incorporated herein by reference in its entirety.

What is claimed is:

1. A connector terminal including:

a terminal body being insertable into a terminal space formed in a housing; and an elastic contact piece arranged in said terminal body, said connector terminal making contact with an inner circumferential surface of a cylindrical terminal while being inserted into said terminal space;

said elastic contact piece having a contact portion comprised of an arcuate surface, said elastic contact piece including a plurality of projections formed on an outer surface of said arcuate surface of said contact portion, each of said projections making contact with an inner arcuate surface of said cylindrical terminal, said plurality of projections being arranged in a circumferential direction of said inner arcuate surface of said cylindrical terminal, said terminal body including a first wall, and a second wall spaced away from and facing said first wall, said second wall being formed with an opening, said elastic contact piece including a first end fixed to said first wall, a second end making abutment with said second wall and being a free end, and a substantially U-shaped bent portion located between said first and second ends, said terminal space including a raised portion having a height from said first wall towards said second wall, when said terminal body is inserted into said terminal space, said bent portion running onto said raised portion, and said contact portion projecting out of said opening, and further, said second end making abutment with said first wall.

2. The connector terminal as set forth in claim 1, wherein said projections are equally spaced away from one another in said circumferential direction.

3. The connector terminal as set forth in claim 1, wherein said projections are arranged symmetrically about a summit of said contact portion.

4. The connector terminal as set forth in claim 1, wherein said projection has an arcuate cross-section.

5. The connector terminal as set forth in claim 1, wherein said contact portion has a curvature equal to the same of said inner arcuate surface of said cylindrical terminal.

6. The connector terminal as set forth in claim 1, wherein the elastic contact piece includes a curved portion defining a convex towards the first wall from the second wall, the second end being continuous to the curved portion, when the bent portion runs onto the raised portion, the curved portion, in place of the second end, making abutment with the first wall.

7. The connector terminal as set forth in claim 1, wherein each of said projections extends in a length-wise direction of said cylindrical terminal.

8. A connector terminal including:

a terminal body being insertable into a terminal space formed in a housing; and an elastic contact piece arranged in said terminal body, said connector terminal making contact with an inner circumferential surface of a cylindrical terminal while being inserted into said terminal space;

said elastic contact piece having a contact portion comprised of an arcuate surface, said elastic contact piece including at least one projection formed on an outer surface of said arcuate surface of said contact portion, said at least one projection making contact with an inner arcuate surface of said cylindrical terminal, said at least one projection extending in a length-wise direction of said cylindrical terminal, wherein said terminal body includes a first wall, and a second wall spaced away from and facing said first wall;

said second wall being formed with an opening, said elastic contact piece including a first end fixed to the first wall, a second end making abutment with said second wall and being a free end and a substantially U-shaped bent portion located between said first end and second ends, said terminal space including a raised portion having a height from said first wall towards said second wall, when said terminal body is inserted into said terminal space, said bent portion running onto said raised portion, and said contact portion projecting out of said opening, and further, said second end making abutment with said first wall.

9. The connector terminal set forth in claim 8, wherein said elastic contact piece further includes a plurality of projections formed on said outer surface of said arcuate surface of said contact portion, and each of said projections making contact with an inner arcuate surface of said cylindrical terminal.

10. The connector terminal as set forth in claim 9, wherein said plurality of projections are equally spaced away from one another in a peripheral direction of said arcuate surface.

11. The connector terminal as set forth in claim 9, wherein said plurality of projections are arranged symmetrically about a top of said contact portion.

12. The connector terminal as set forth in claim 9, wherein said projections are equally spaced away from one another in a circumferential direction of said arcuate surface.

13. The connector terminal as set forth in claim 9, wherein said projections are arranged symmetrically about a summit of said contact portion.

14. The connector terminal as set forth in claim 8, wherein said projection has an arcuate cross-section.

15. The connector terminal as set forth in claim 8, wherein said contact portion has a curvature equal to the same of said inner arcuate surface of said cylindrical terminal.

16. The connector terminal as set forth in claim 8, wherein the elastic contact piece includes a curved portion defining a convex towards the first wall from the second wall, the second end is continuous to the curved portion, when the bent portion runs onto the raised portion, the curved portion, in place of the second end, makes abutment with the first wall.

* * * * *